US011519174B2

(12) United States Patent
Dicaire

(10) Patent No.: US 11,519,174 B2
(45) Date of Patent: Dec. 6, 2022

(54) BUILDING STRUCTURE FORMED BY TRUSS MODULES AND METHOD OF FORMING

(71) Applicant: OMG, Inc., Agawam, MA (US)

(72) Inventor: Mark A. Dicaire, Boylston, MA (US)

(73) Assignee: OMG, Inc., Agawam, MA (US)

( * ) Notice: Subject to any disclaimer, the term of this patent is extended or adjusted under 35 U.S.C. 154(b) by 71 days.

(21) Appl. No.: 16/906,435

(22) Filed: Jun. 19, 2020

(65) Prior Publication Data

US 2020/0385990 A1 Dec. 10, 2020

Related U.S. Application Data

(63) Continuation-in-part of application No. 15/248,069, filed on Aug. 26, 2016.

(Continued)

(51) Int. Cl.

*E04C 3/16* (2006.01)
*E04B 1/00* (2006.01)

(Continued)

(52) U.S. Cl.

CPC ..... *E04C 3/16* (2013.01); *E04B 1/003* (2013.01); *E04B 2/707* (2013.01); *E04B 5/12* (2013.01);

(Continued)

(58) Field of Classification Search

CPC ..... E04B 2001/2418; E04B 1/2403; E04B 1/003; E04B 2/707; E04B 2001/2696;

(Continued)

(56) References Cited

U.S. PATENT DOCUMENTS 852,665 A ‡ 5/1907 Kellogg ..... 52/690
1,554,224 A * 9/1925 McGrath ..... B64C 1/08 52/693

(Continued)

FOREIGN PATENT DOCUMENTS

DE 10202497 A1 ‡ 10/2002 ..... B27M 3/0046
EP 0448915 A1 ‡ 10/1991 ..... E04B 7/22

(Continued)

OTHER PUBLICATIONS

EP 0448915 A1 English Translation (Year: 1991).‡

*Primary Examiner* — Brent W Herring
(74) *Attorney, Agent, or Firm* — Alix, Yale & Ristas, LLP

(57) ABSTRACT

Disclosed herein is a method of manufacturing a modular building structure. A plurality of structural truss modules are provided. Each one of the structural truss modules includes a spaced pair of elongated wood chords and a web connecting the elongated wood chords. The web including a plurality of metal support rods each having a pair of opposed threaded sections. The first of the pair of opposed threaded sections engaged to a first one of the elongated wood chords at an angle thereto. The second of the pair of opposed threaded sections engaged to the other one of the elongated wood chords at an angle thereto. The structural truss modules are cut to a predetermined length. A first member is connected between the spaced pairs of elongated wood chords. First ends of the plurality of structural truss modules are configured to connect to a ledger member.

17 Claims, 42 Drawing Sheets

Related U.S. Application Data

(60) Provisional application No. 62/210,026, filed on Aug. 26, 2015.

(51) Int. Cl.

| | |
|---|---|
| ***E04C 3/292*** | (2006.01) |
| ***E04B 2/70*** | (2006.01) |
| ***E04B 5/12*** | (2006.01) |
| *E04C 3/02* | (2006.01) |
| *E04B 1/26* | (2006.01) |

(52) U.S. Cl.
CPC ..... *E04C 3/292* (2013.01); *E04B 2001/2696* (2013.01); *E04C 2003/026* (2013.01)

(58) Field of Classification Search
CPC ..... E04B 5/12; E04C 2003/0413; E04C 3/16; E04C 2003/026; E04C 3/292; F16B 25/0057; F16B 5/0275
USPC ..... 52/633, 636, 690, 693, 654.1, 650.1, 52/650.3, 652.1, 653.1
See application file for complete search history.

(56) References Cited

U.S. PATENT DOCUMENTS 2,342,916 A ‡ 2/1944 Blaski ..... E04C 3/42 52/642
3,778,946 A * 12/1973 Wood ..... E04C 3/18 52/223.8
3,961,455 A ‡ 6/1976 Peters ..... E04B 1/2612 52/693
4,069,635 A * 1/1978 Gilb ..... E04C 3/292 52/693
4,173,857 A * 11/1979 Kosaka ..... E04C 3/42 52/223.8
4,282,619 A * 8/1981 Rooney ..... E01D 2/04 14/6
4,653,244 A ‡ 3/1987 Farrell ..... E04F 13/0837 411/399
4,819,400 A ‡ 4/1989 Kindberg ..... E04C 3/292 52/693
5,301,487 A ‡ 4/1994 Wiebe ..... E04B 1/26 52/742.12
5,644,888 A * 7/1997 Johnson ..... B29C 70/525 52/651.01
5,746,039 A ‡ 5/1998 Nystrom ..... E04C 3/04 411/387.1
5,816,012 A ‡ 10/1998 Willis ..... E04C 3/04 411/387.1
6,074,149 A ‡ 6/2000 Habermehl ..... F16B 25/0015 206/347
6,243,996 B1 * 6/2001 Oliver ..... E04G 23/0218 248/200.1
6,325,583 B1 ‡ 12/2001 Mattle ..... E04B 5/12 411/387.6
6,427,403 B1 * 8/2002 Tambakis ..... E04B 5/023 52/309.1
6,688,059 B1 * 2/2004 Walker ..... E04B 1/003 52/302.3
7,150,132 B2 ‡ 12/2006 Commins ..... E04B 1/26 52/293.3
7,695,228 B2 ‡ 4/2010 Craven ..... F16B 5/0275 411/399
7,832,173 B2 ‡ 11/2010 Crawford ..... E04C 3/16 411/387.1
8,656,650 B2 ‡ 2/2014 Gray ..... E04B 1/2608 411/525
8,739,489 B2 * 6/2014 Weber ..... E04F 15/02183 52/510
9,038,347 B2 * 5/2015 Gundersen ..... E04C 3/292 52/636
9,499,983 B2 * 11/2016 Gundersen ..... E04C 3/46
9,765,520 B2 * 9/2017 Armbrust ..... E04C 3/08
9,822,521 B1 * 11/2017 Kuo ..... E04B 5/10
10,072,416 B2 * 9/2018 Armbrust ..... E04C 3/08
2004/0226252 A1 * 11/2004 Sheldon ..... E04C 3/12 52/716.1
2004/0255551 A1 * 12/2004 Fuhr ..... E04F 15/02458 52/782.1
2005/0252152 A1 ‡ 11/2005 Belinda ..... E04C 3/11 52/690
2006/0201581 A1 ‡ 9/2006 Belinda ..... F16B 5/0275 144/344
2008/0245030 A1 ‡ 10/2008 Sieber ..... E04B 2/707 52/782.1
2010/0180540 A1 * 7/2010 Shepard ..... E04B 1/18 52/745.05
2014/0174017 A1 * 6/2014 Gundersen ..... E04C 3/46 52/636
2014/0338279 A1 * 11/2014 Armbrust ..... E04C 3/08 52/634
2016/0194869 A1 ‡ 7/2016 Thornton ..... E04C 3/12 52/233
2018/0094435 A1 * 4/2018 Armbrust ..... E04B 1/2403
2018/0135316 A1 * 5/2018 Apostolopoulos ..... E04G 7/307

FOREIGN PATENT DOCUMENTS

EP 2256262 A1 ‡ 12/2010 ..... E04B 1/10
EP 2256262 B1 5/2013
FR 865513 5/1941
FR 865513 A ‡ 5/1941 ..... E04B 1/2604

* cited by examiner
‡ imported from a related application

PRIOR ART

BUILDING STRUCTURE FORMED BY TRUSS MODULES AND METHOD OF FORMING

CROSS-REFERENCE TO RELATED APPLICATION

This application is a continuation-in-part of U.S. patent application Ser. No. 15/248,069, filed on Aug. 26, 2016, which claims priority to U.S. Provisional Patent Application No. 62/210,026, filed on Aug. 26, 2015, the entire contents of which is hereby incorporated by reference its entirety.

BACKGROUND

This disclosure relates generally to truss modules employed in building constructions, such as a decking structure for example. More particularly, this disclosure relates to truss modules that are sizable and adaptable for forming a decking structure and a related method of constructing a decking structure.

Conventional structural truss modules, to which the present disclosure relates, are exemplified in FIGS. 1A, 1B, 1C, 1D, 13A and 13B. The truss modules, which may have numerous applications, such as in connection with roofs, floors, headers, walls and other structures, are typically characterized by a pair of equidistantly spaced wood chords which are interconnected by a web principally composed of wood or wood-derived components. These conventional structural modules are characterized by the web occupying a significant portion of the space between the chords. This latter characteristic typically presents significant obstacles to the placement of longitudinally extending components, such as utility lines, in a location between the chords. The wood components naturally also have the same fire resistant qualities as the chords to which they connect.

SUMMARY

In accordance with one aspect of the present disclosure, a method of manufacturing a modular building structure is disclosed. A plurality of structural truss modules are provided. Each one of the structural truss modules includes a spaced pair of generally parallel elongated wood chords and a web connecting the elongated wood chords. The web including a plurality of metal support rods each having a pair of opposed threaded sections. The first of the pair of opposed threaded sections engaged to a first one of the elongated wood chords at an angle thereto. The second of the pair of opposed threaded sections engaged to the other one of the elongated wood chords at an angle thereto. Each one of the structural truss modules are cut to a predetermined length. The structural truss modules are arranged with the wood chords substantially flat and adjacent one another. The structural truss modules are substantially evenly spaced in a generally parallel orientation. A first member is connected between the spaced pairs of elongated wood chords of the plurality of structural truss modules. First ends of the plurality of structural truss modules are configured to connect to a ledger member.

In accordance with another aspect of the present disclosure, a method of manufacturing a modular building structure is disclosed. A first preassembled structural truss module is provided. The first preassembled structural truss module Includes a first elongated support beam, a second elongated support beam, and a web connecting said elongated support beams. Said web including a plurality of rods each having a pair of opposed threaded sections. The first elongated support beam is generally parallel to the second elongated support beam. The first elongated support beam includes a first surface, a second surface, and a plurality of fastener openings extending between the first surface and the second surface. A first one of the opposed threaded sections is threadably engaged with a portion of one of the plurality of openings of the first elongated support beam. A second one of the opposed threaded sections is threadably engaged with the second elongated support beam. A second preassembled structural truss module is provided. The second preassembled structural truss module Includes a first elongated support beam, a second elongated support beam, and a web connecting said elongated support beams. Said web including a plurality of rods each having a pair of opposed threaded sections. The first elongated support beam is generally parallel to the second elongated support beam. The first elongated support beam includes a first surface, a second surface, and a plurality of fastener openings extending between the first surface and the second surface. Each rod includes opposed threaded sections. A first one of the opposed threaded sections is threadably engaged with a portion of one of the plurality of openings of the first elongated support beam. A second one of the opposed threaded sections is threadably engaged with the second elongated support beam. The first preassembled structural truss module is cut at a predetermined length between the plurality of fastener openings. The second preassembled structural truss module is cut at a predetermined length between the plurality of fastener openings. A first member is secured between the first elongated support beam and the second elongated support beam of the first preassembled structural truss module. The first member is secured between the first elongated support beam and the second elongated support beam of the second preassembled structural truss module. The first surface of the first elongated support beam of the first preassembled structural truss module is substantially coplanar with the first surface of the first elongated support beam of the second preassembled structural truss module.

In accordance with another aspect of the present disclosure, a modular building structure including a plurality of structural truss modules is disclosed. Each one of the structural truss modules includes a spaced pair of elongated wood chords and a web connecting said elongated wood chords. Said web including a plurality of metal support rods each having a pair of opposed threaded sections. The first of the pair of opposed threaded sections is engaged to a first one of the elongated wood chords at an angle thereto. The second of the pair of opposed threaded sections is engaged to the other one of the elongated wood chords at an angle thereto. The spaced pair of elongated wood chords are generally parallel to each other. Each one of the plurality of structural truss modules is substantially evenly spaced from each other and arranged in a generally parallel orientation. A first member extends between the spaced pair of elongated wood chords of the plurality of structural truss modules. A second member extends between the spaced pair of elongated wood chords of the plurality of structural truss modules.

DETAILED DESCRIPTION

Figure 10:
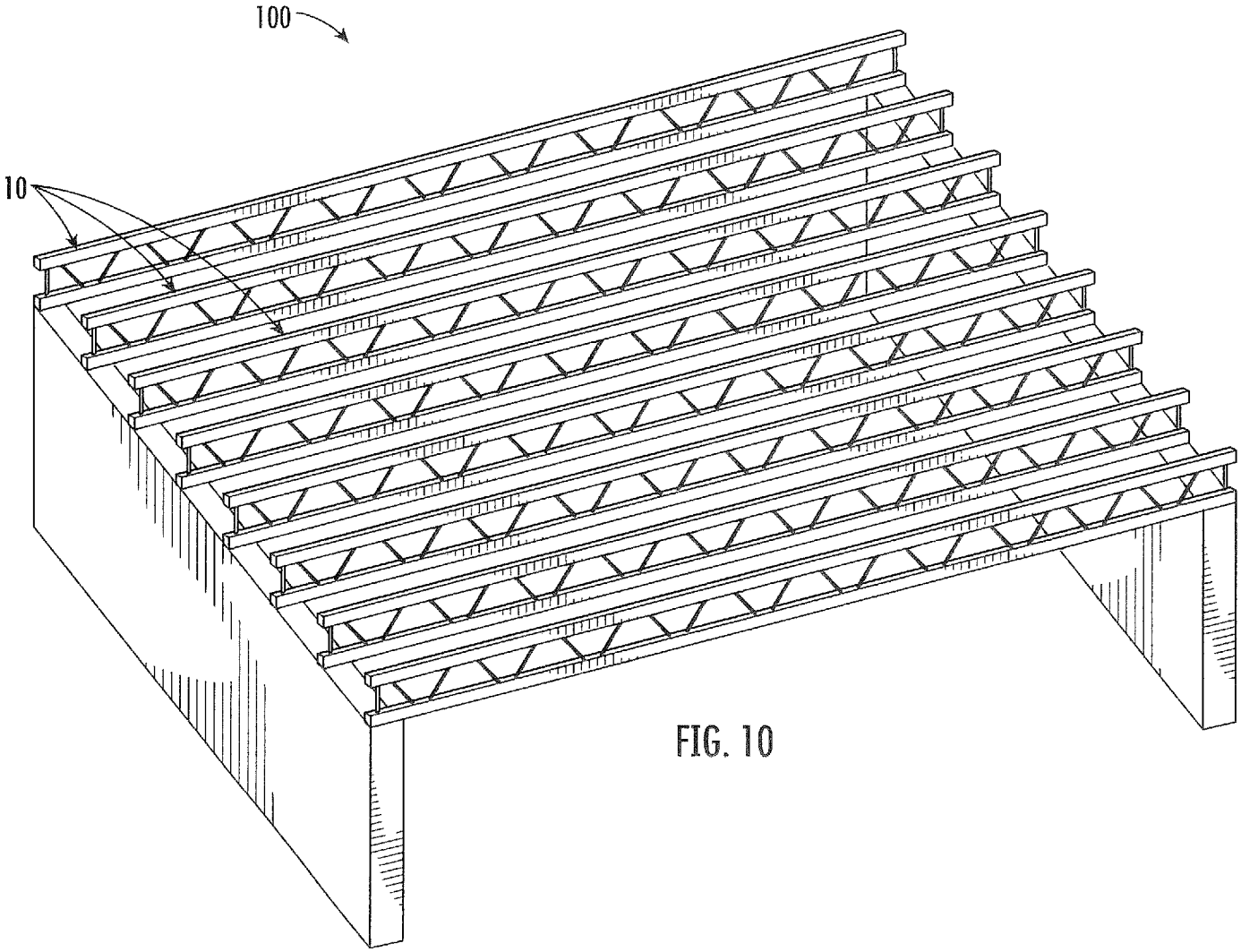
FIG. 10 is a perspective view illustrating a multiplicity of roof or floor truss modules installed on a pair of parallel support walls.

With reference to the drawings wherein like numerals represent like parts throughout the figures, a structural truss module is generally designated by the numeral 10. The structural truss module 10 can be constructed in a wide range of sizes and can provide a number of structural functions in an integrated construction, such as for a roof or floor truss assembly 100 illustrated in FIG. 10, a reinforced structural shear wall 200 illustrated in FIGS. 15 and 16 and a header structure for a wall 300 illustrated in FIGS. 17 and 18.

The structural roof or floor truss module 10 can be selectively configured in a number of standard heights H, such as 7¼, 9½, 11⅞, 14, 16 and 18 inches, and various lengths L as dictated by a given application. The structural truss module 10, in accordance with the present disclosure, allows for the ability to custom construct the module having specific dimensions as required.

Figure 1A:
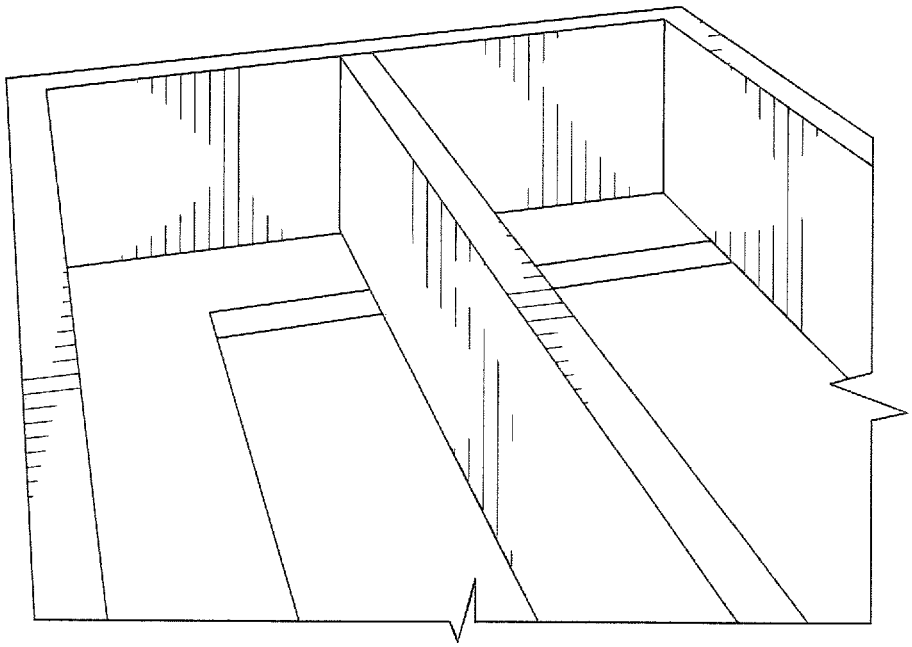
PRIOR ART FIG. 1A
FIG. 1A is a perspective view of a prior art floor joist constructed of dimensional lumber.
Figure 1B:
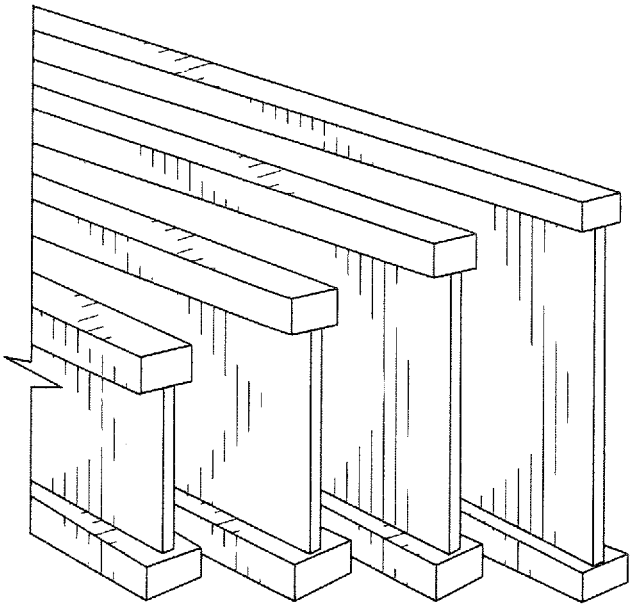
PRIOR ART FIG. 1B
FIG. 1B is a perspective view of portions of prior art I-joist employed as a floor joist or truss.
Figure 1C:
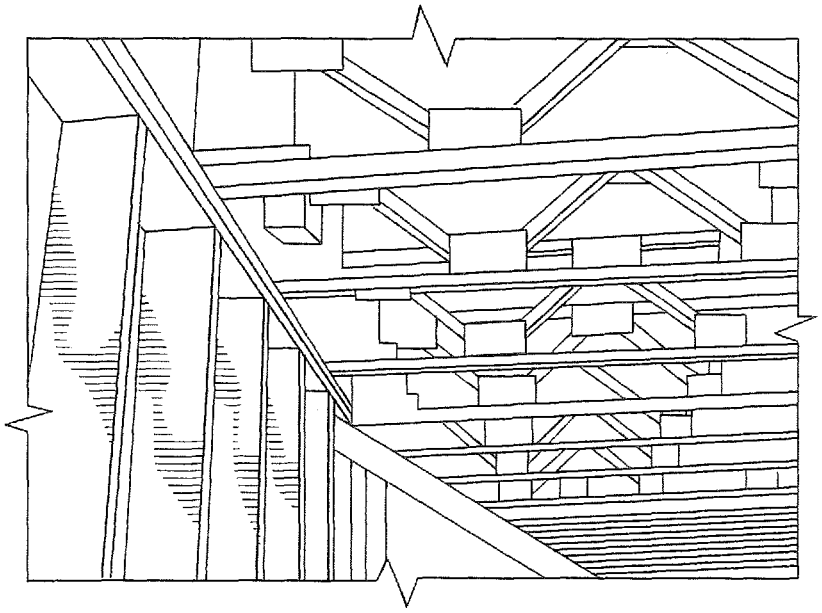
PRIOR ART FIG. 1C
FIG. 1C is a perspective view of a prior art metal plated open web truss mounted in a pre-construction phase.
Figure 1D:
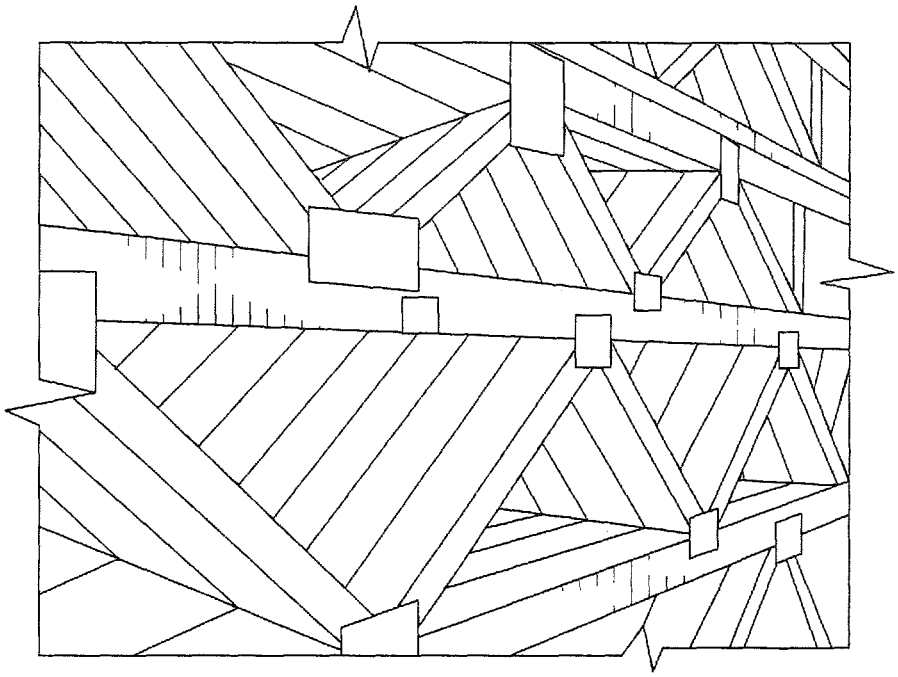
PRIOR ART FIG. 1D
FIG. 1D is a perspective view of a stack of prior art open web trusses.

In one preferred form of the structural truss module as a roof truss or a floor joist, the structural truss module 10 functions as a ready replacement for a dimensional lumber-type floor joist as represented in FIG. 1A, an I-joist such as represented in FIG. 2B, or an open web roof or floor truss assembly such as represented in FIG. 1C. The features of the structural truss assembly allow for construction of the structural truss module as required and allow for efficiencies over a prior art representative load of stacked roof trusses, such as illustrated in FIG. 1D, by effectively replacing the latter with a compact load of wood chords and a pallet of fasteners, as will be described below.

With reference to FIGS. 2, 4, 5 and 9, a representative structural truss module 10 suitable for a truss is constructed from a pair of wood chords 20 and 22 which are joined by a web 30 comprising a matrix of metal fasteners 40. The chords may be 2×3, 2×4 or other structural lumber components having a desired length L. The fasteners 40 are dimensioned in accordance with the desired height H of the truss. For a given truss, the fasteners 40 are preferably identical although identical fasteners are not required. For a given truss module, the lengths L of the chords are preferably equal although equal lengths for chords 20 and 22 are not required. Alternatively, the chords need not be oriented in the 2× direction as illustrated, but may essentially assume a 3×2 or 4×2 orientation.

Figure 7:
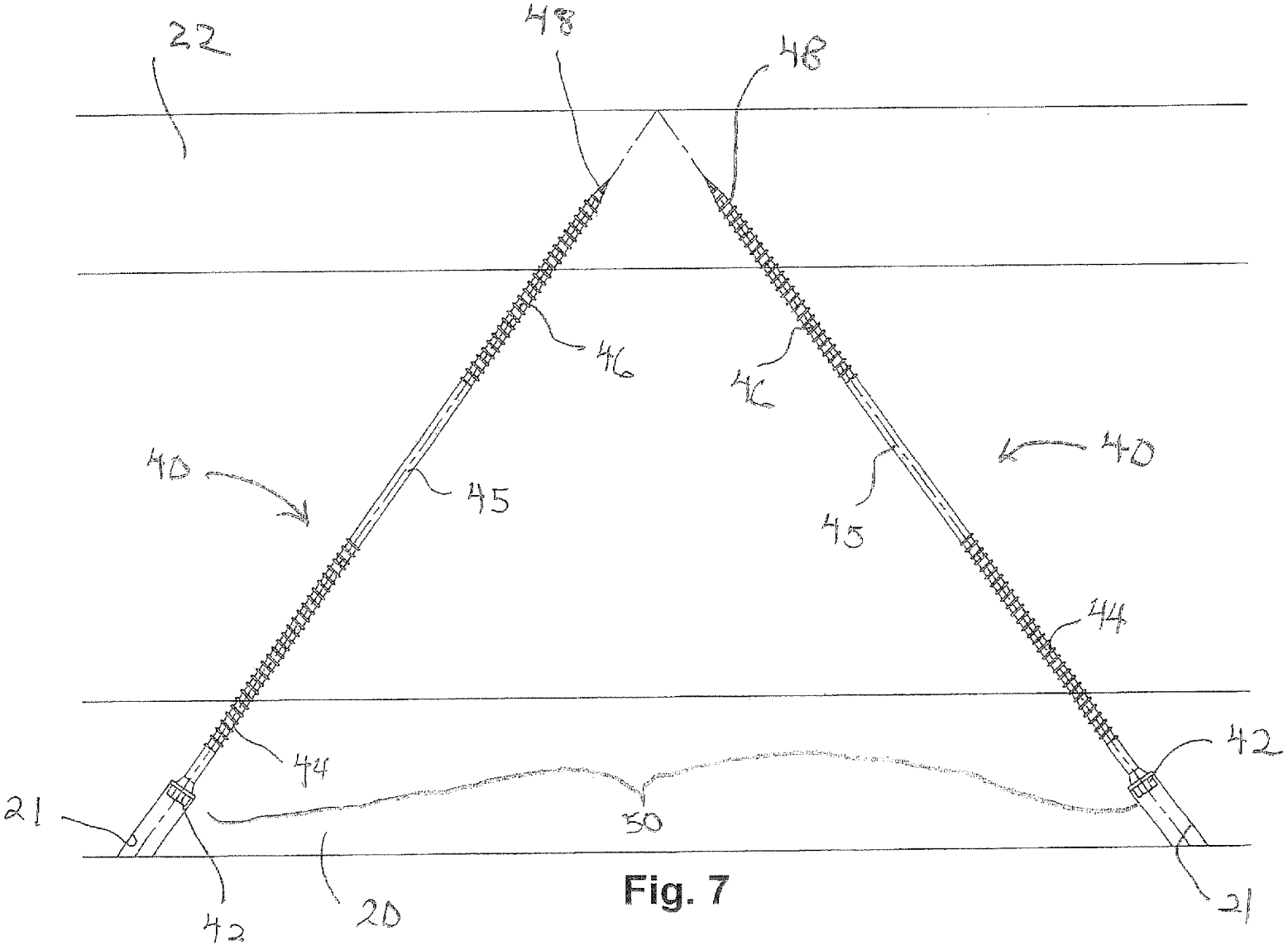
FIG. 7 is an enlarged fragmentary sectional view, partly in schematic, of a roof or floor truss module.

With reference to FIG. 7, the fasteners 40 are elongated screws having a head 42 for receiving a high drive torque, a first threaded portion 44 generally adjacent the head, an unthreaded medial portion 45, a second threaded portion 46 adjacent the distal end, and a tip 48 which facilitates penetration into the wood chords. In one configuration, the fasteners 40 are oriented at an angle of approximately 45° to the chord 20, and are drilled from the bottom chord 20 to the top chord 22 at the pre-determined angle. Upon the final installation, the first threaded portion 44 threadably engages the lower chord 20 and the second threaded portion 46 threadably engages the upper chord 22. Naturally, the upper and lower designations are arbitrary. The thread tips 48 preferably terminate approximately one inch to one and a half inches below the upper edge of chord 22. In one manufacturing process, a pilot bore 21 is pre-formed in the chord 20 at the given angle for each fastener.

In certain embodiments, the fastener matrix comprises a series of fastener pairs 50. The fastener of each pair is oriented so that the central axes of the fasteners essentially intersect at the top edge 24 of chord 22 (FIG. 7). The fastener tips 48 never engage. It is desired that the head 42 be seated below the bottom edge 26 of chord 20 approximately at a one inch to a one and a half inch spacing from the edge. For a given chord, the spacing is preferably uniform.

Figure 2:
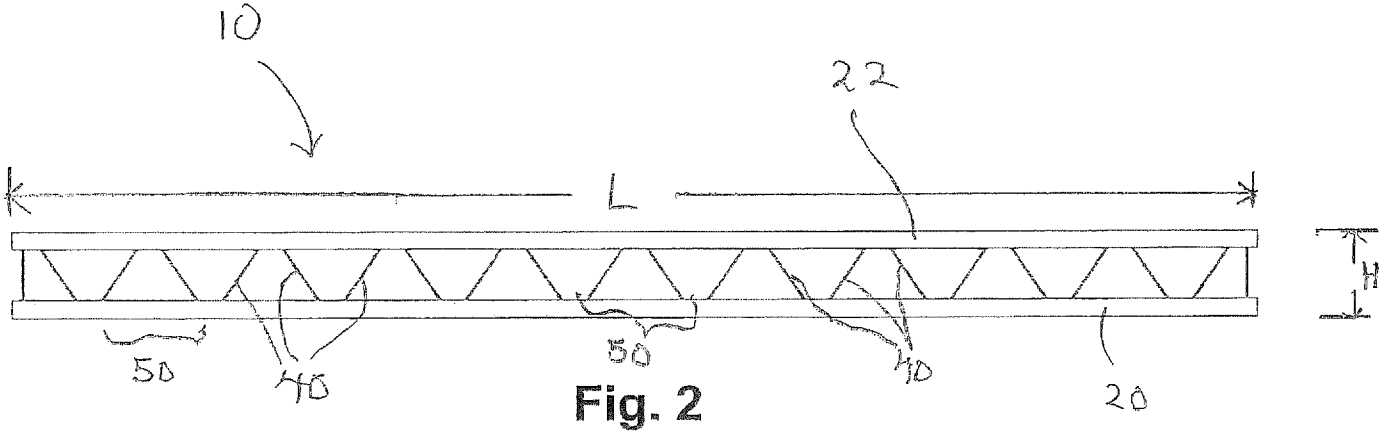
FIG. 2 is a diagrammatic side elevational view of one embodiment of a roof or floor truss module.
Figure 4:
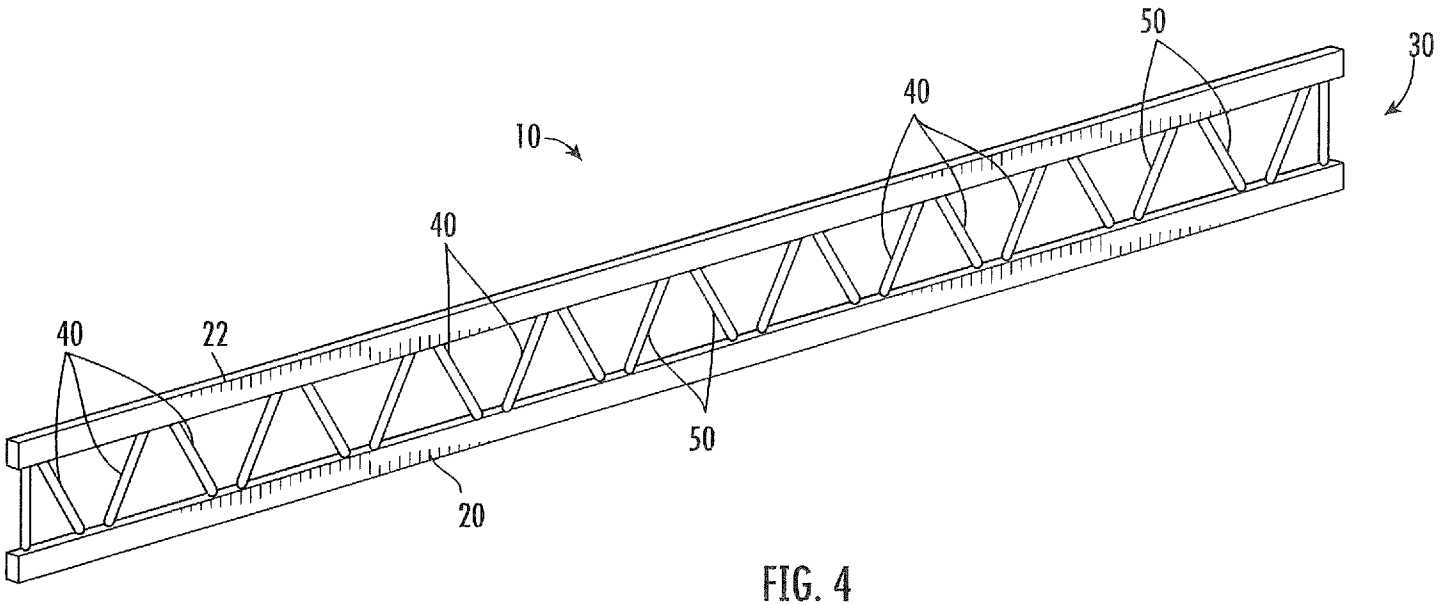
FIG. 4 is a perspective view of a roof or floor truss module.
Figure 5:
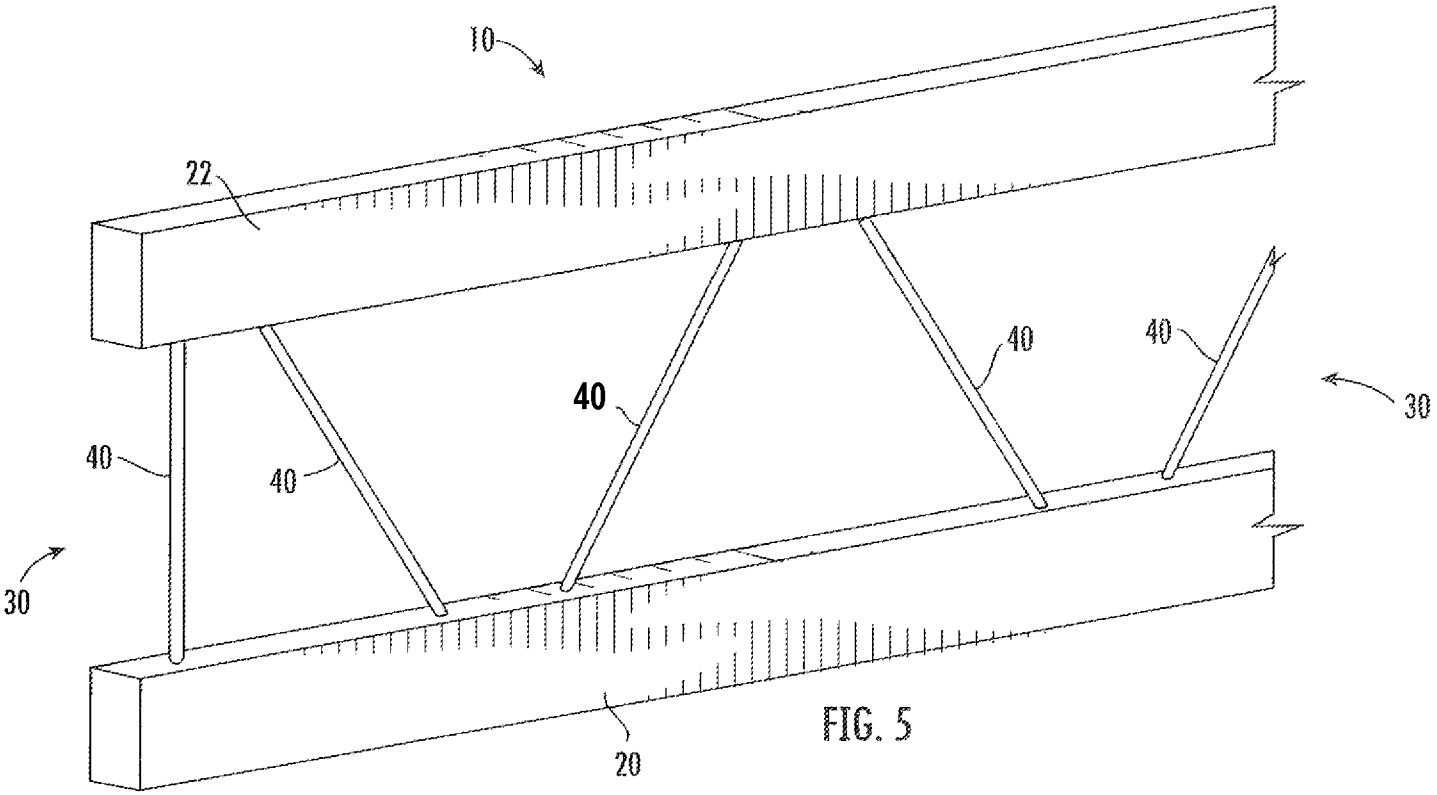
FIG. 5 is an enlarged fragmentary view of the roof or floor truss module of FIG. 4.
Figure 9:
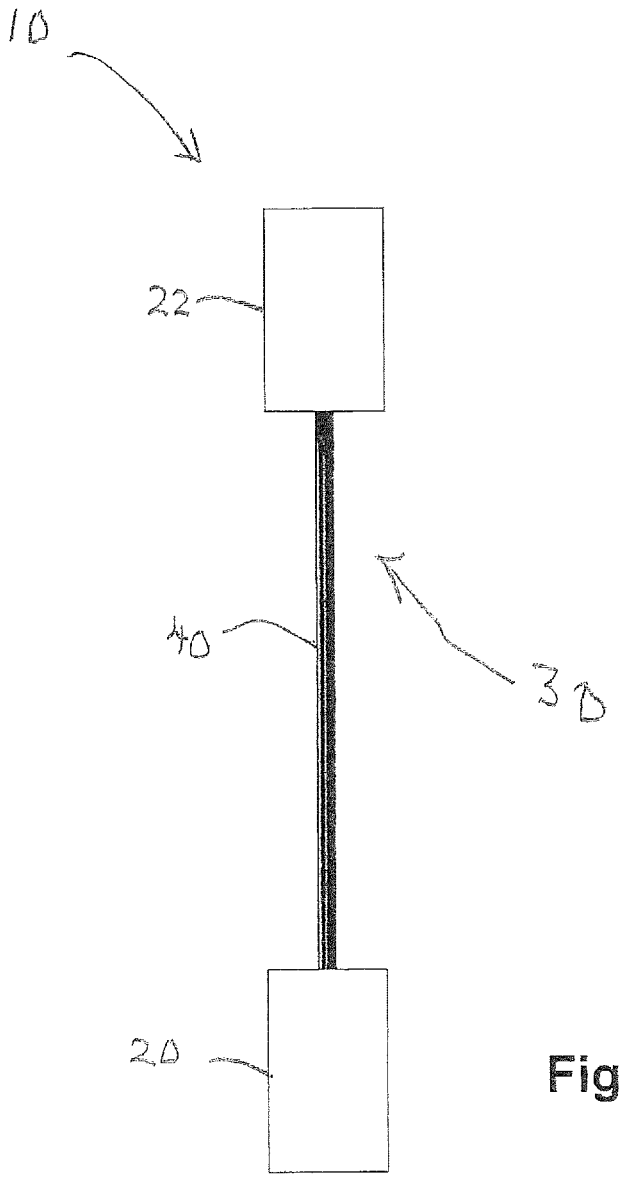
FIG. 9 is an enlarged end view of a roof or floor truss module.

As best represented in FIG. 9, the fasteners are driven and disposed on the center lines of the chords and generally transversely aligned along the length of the chord. In one configuration, as best illustrated in FIGS. 2 and 4, at the ends of the chords, one fastener 40 is driven at a vertical angle or 90° angle to the chords.

A representative manufacturing method for a representative structural truss module 510 is schematically illustrated in FIGS. 19A-19D. A jig assembly 500 employs a reference shoulder 502 and a plurality of jigs 504 for securing a first chord 522 at a fixed position. A second set of jigs 506 secure a substantially identical second chord 520 at an opposed second position equidistantly spaced from the first chord.

Multiple guides 508 are disposed in fixed position between the chords to provide the proper entry angle for the fasteners 540. In one embodiment, the guides 508 are angularly adjustable and adapted to be fixed at the selected angular position. A drill 515 or a series of drills 515 are activatable to drill a pilot bore in the bottom chord 520 at the given angles illustrated. It will be appreciated that some of the pilot bore formations are done sequentially because of the angular relationships of the pilot bores for the truss module 510.

Figure 19A:
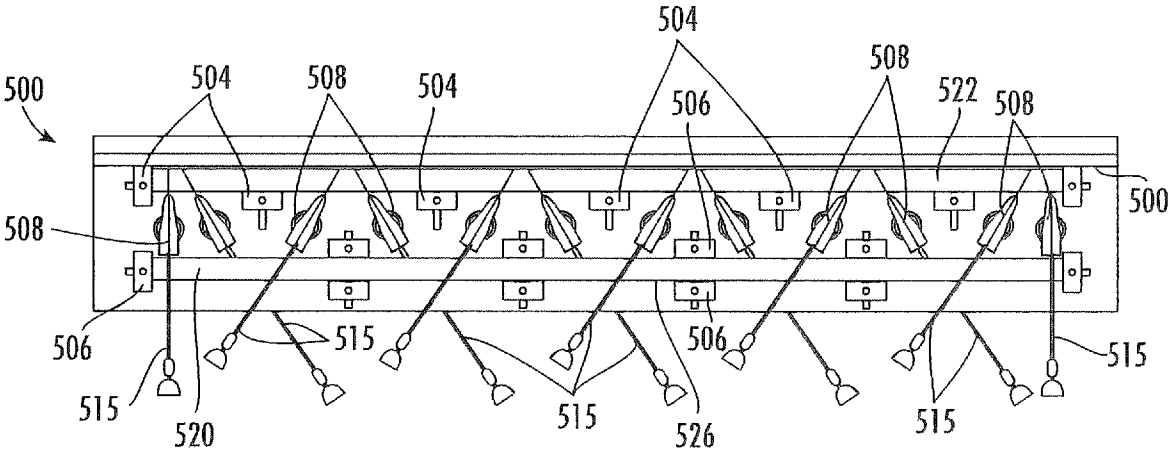
FIGS. 19A-19D are annotated schematic views illustrating a representative manufacturing process for a representative structural truss module.
Figure 19B:
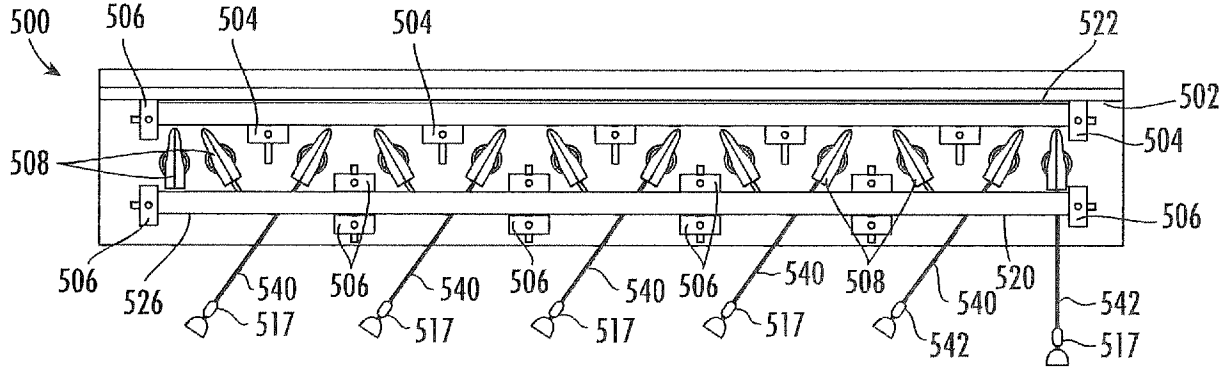

As best illustrated in FIG. 19B, a first set of fasteners 540 is installed by a torque driver 517 driving the fasteners through the pilot bores at a first angle, and at a right angle on one end as illustrated so that the fasteners 540 are threadably engaged in the first chord 522 and threadably embedded in the second or bottom chord 520. The driving of the fasteners can be done concurrently. In a preferred embodiment, the head 542 of each fastener is driven into the chord 520 a pre-established distance from the edge 526. The end fasteners may have a shorter length than the fasteners driven at an angle. Fasteners 540 preferably have substantially the same geometry as fasteners 40.

Figure 19C:
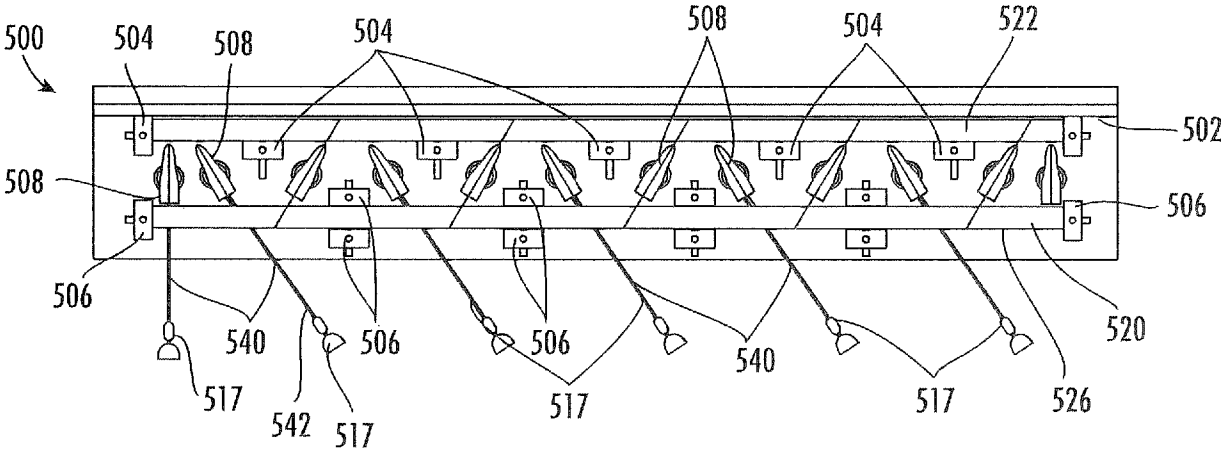

With reference to FIG. 19C, a second set of fasteners is then driven through the other pilot bores and the 90° pilot bore so that the head 542 of each fastener is embedded in the second chord and the fasteners threadably engage the first chord. Again, the driving of the second set of fasteners 540 may be accomplished concurrently.

Figure 19D:
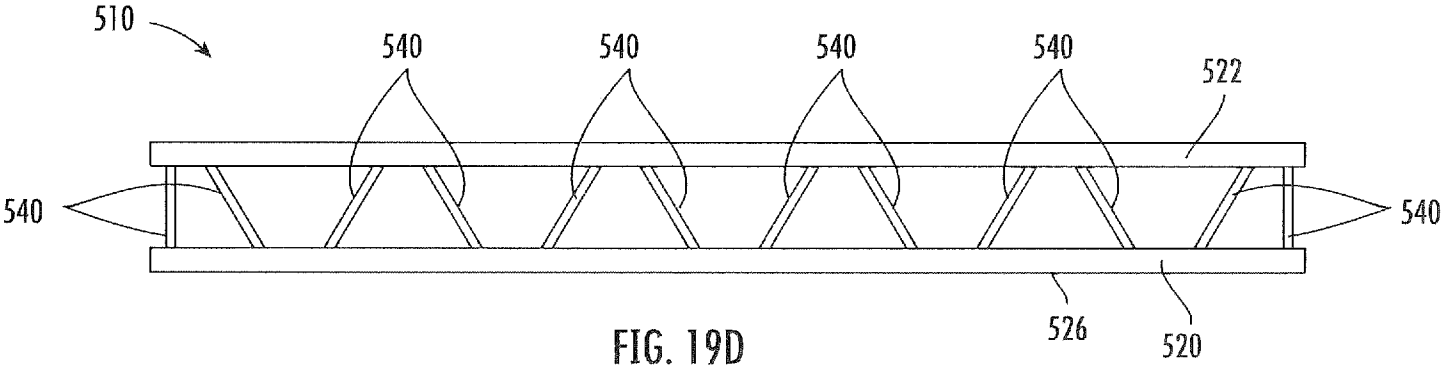

Once the second set of fasteners has been driven, the constructed truss module 510 is then removed from the jigs. The finished structural truss module 510 is illustrated in FIG. 19D.

Figure 8:
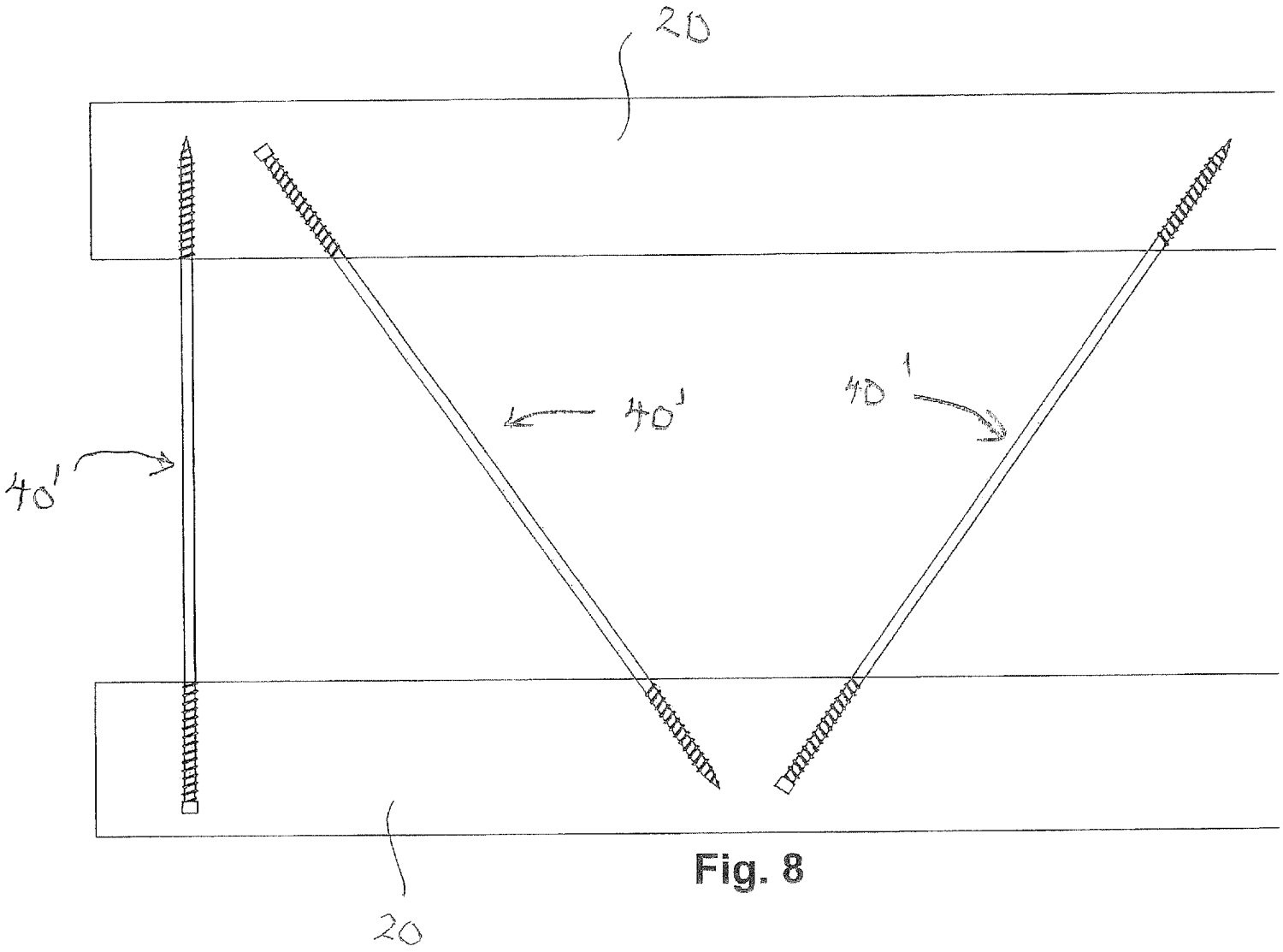
FIG. 8 is an enlarged fragmentary sectional view of a roof or floor truss module.
Figure 12:
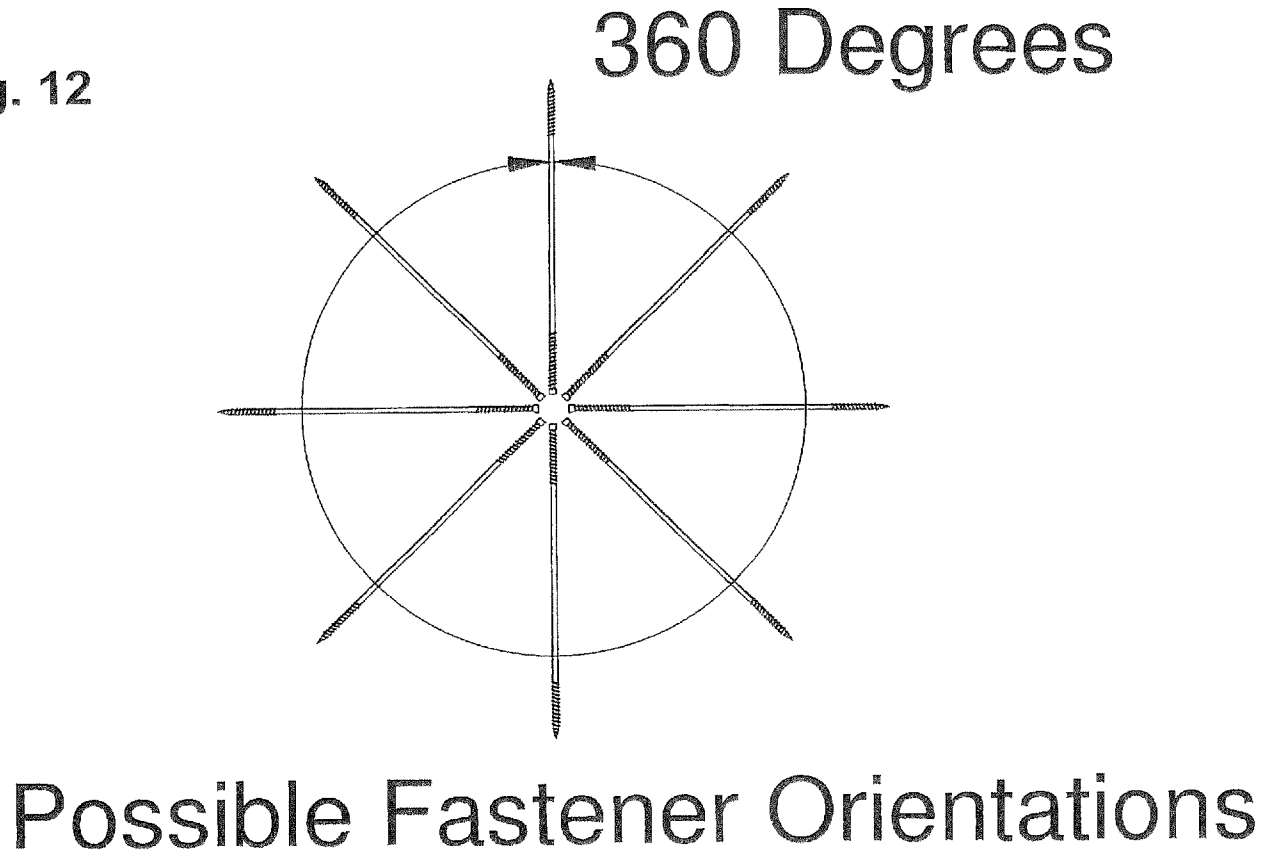
FIG. 12 is a schematic diagram illustrating the various possible fastener orientations for fasteners employed in various roof truss modules.

As best shown in FIG. 8, in one embodiment, the vertically oriented fastener is driven initially through the bottom edge 26. The next fastener in the web array is initially driven through the top edge 24 and the third fastener in the web array is initially driven through the bottom edge 26. Alternatively, the fasteners may be driven from the same edge or non-alternating edges. The fasteners may be driven at various angles and orientations relative to the chords, as schematically suggested in FIG. 12. Preferably, the web is formed by a series of angled quasi-convergent pairs 50 of fasteners.

Figure 11:
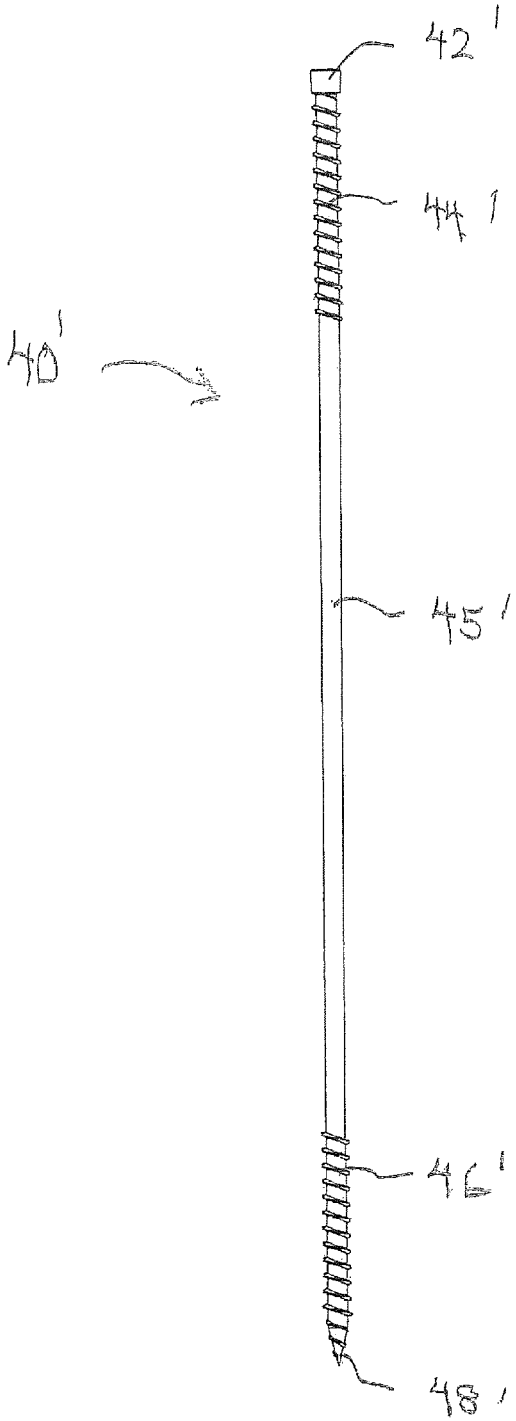
FIG. 11 is an enlarged side view of a fastener which may be employed in any of the roof or floor truss modules.

Another suitable fastener 40' is illustrated in FIG. 11 and comprises a drive head 42 which receives a drive torque, a threaded portion 44' adjacent the head and a second threaded portion 46' adjacent the distal end extending to the tip 48'. A medial portion 45' of substantial extent is not threaded. The unthreaded portion 45' extends a greater distance than that of portion 45, and the threaded portions 44' and 46' extend a smaller distance than threaded portions 44 and 46. Naturally, other fasteners may be employed. The fasteners for a given truss module need not be identical.

With reference to FIGS. 20A-20D, single, double, triple and quadruple representative structural truss module embodiments are shown as 610A, 610B, 610C and 610D, respectively. For structural truss module 610A, an array of single fasteners 640 is employed and the fasteners preferably connect the wood chords 620 and 622 along a medial transverse line l of the chords.

Structural truss module 6106 employs groups 651, 652, 653, 654 . . . of pairs of parallel fasteners 640 which are preferably equidistantly threaded into the chords 620 and 622 at locations which are equidistantly spaced from a longitudinal medial line l through the chords.

Structural truss module 610C employs groups 661, 662, 663, 664 . . . of three parallel fasteners 640. A medial set of the fasteners engages the chords 620 and 622 at spaced locations along a medial line l. A second set of the fasteners are equidistantly spaced from the medial line and longitudinally offset from the first set, as illustrated.

Figure 20A:
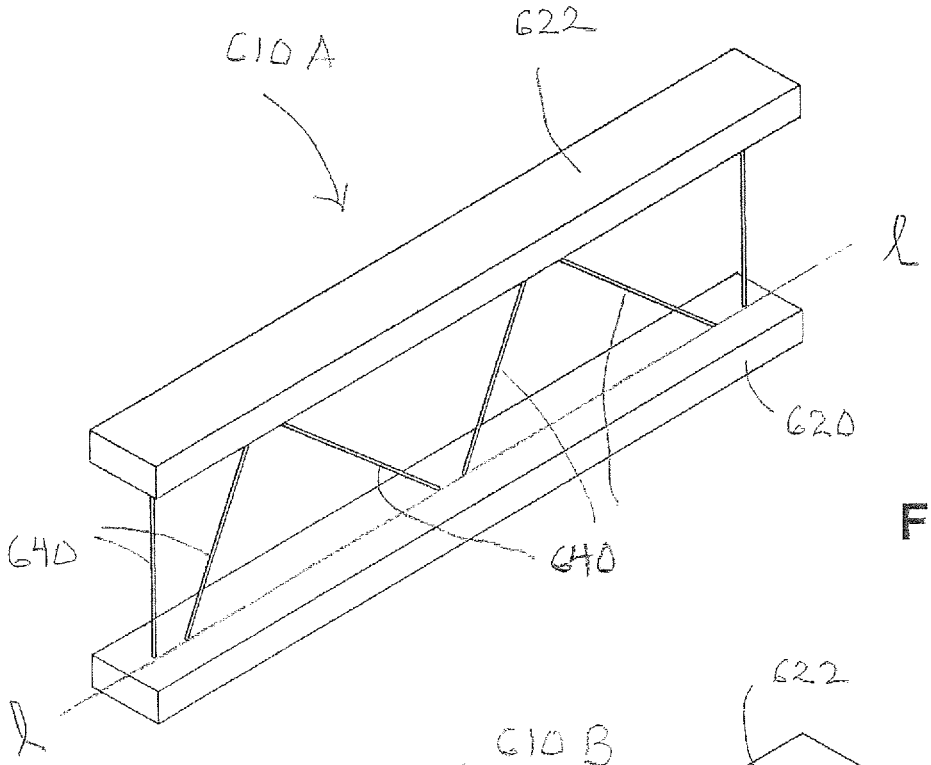
FIGS. 20A-20D are representative perspective views of structural truss modules with a single web configuration, a double web configuration, a triple web configuration and a quadruple web configuration, respectively.
Figure 20B:
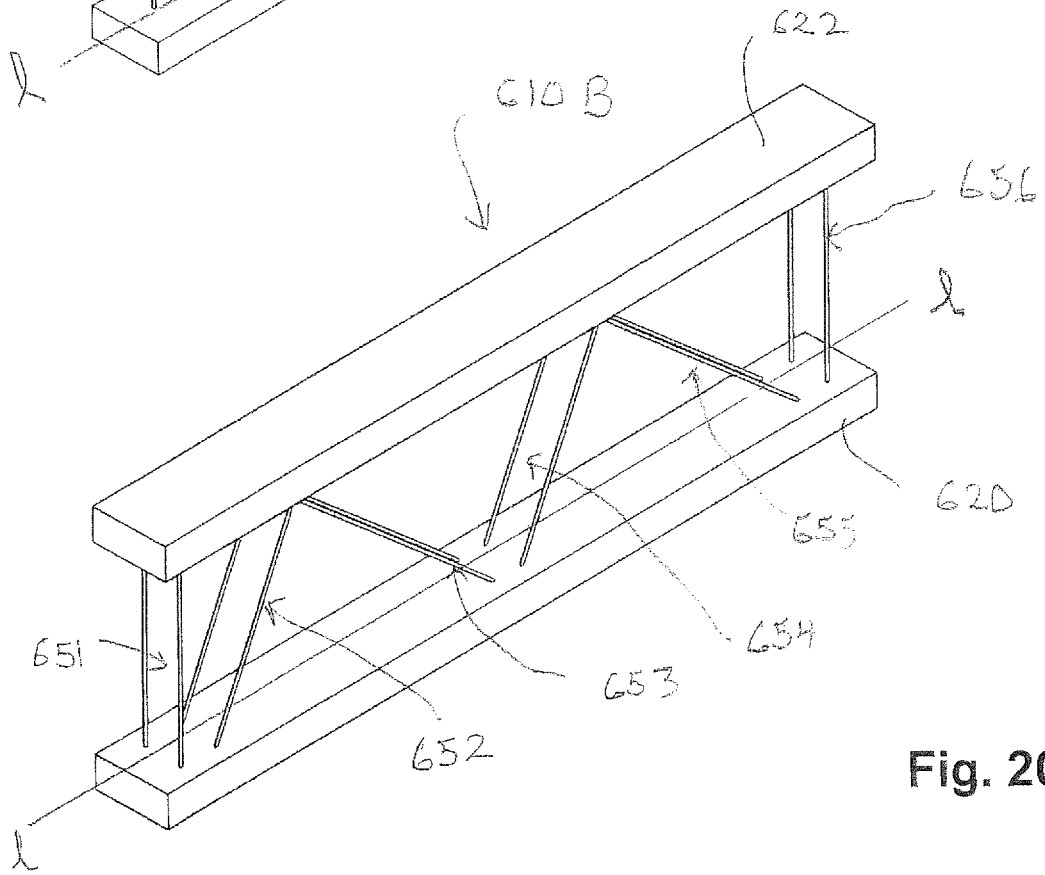
Figure 20C:
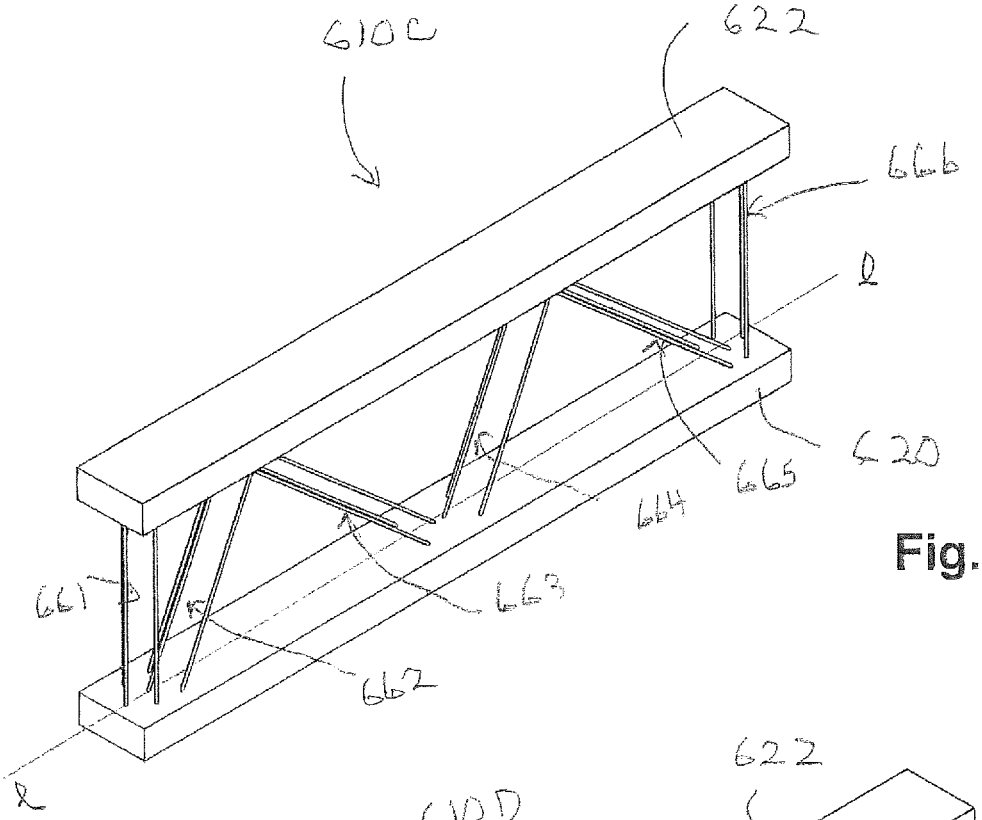
Figure 20D:
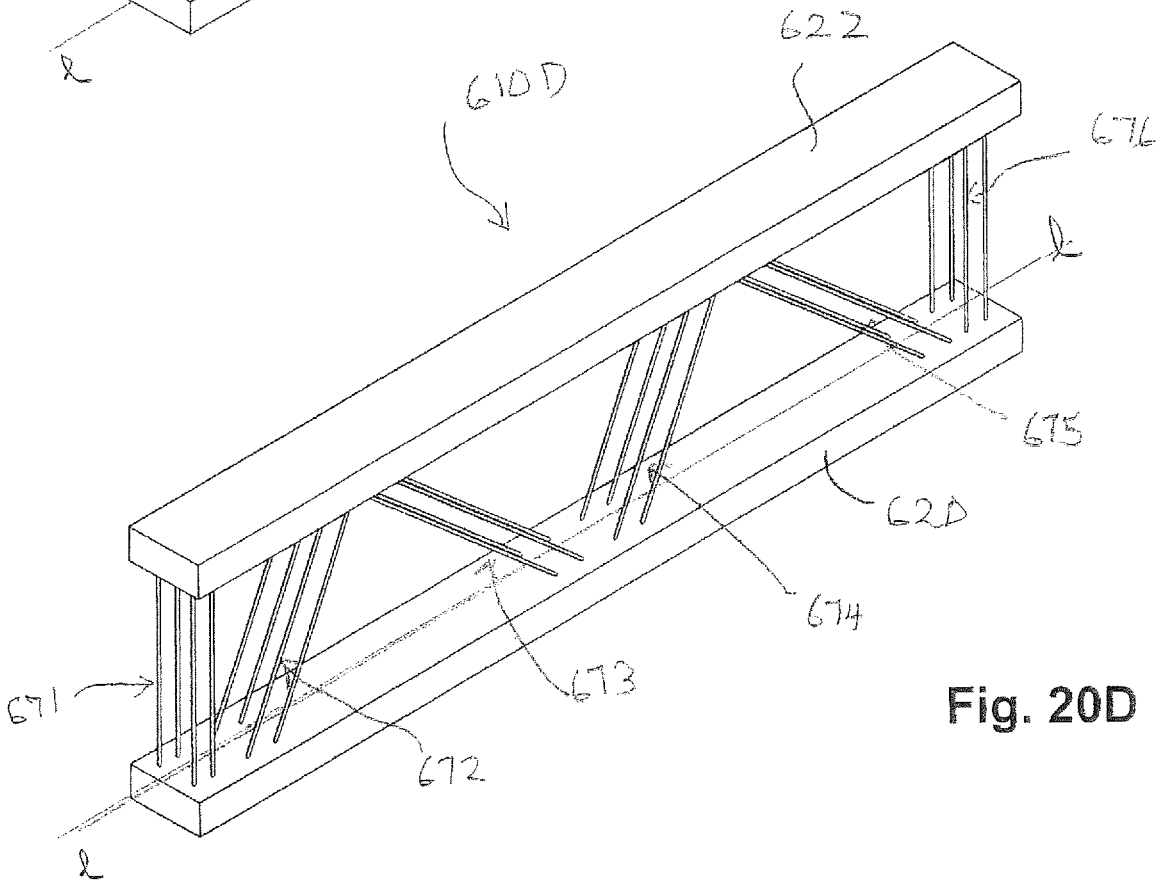

As illustrated in FIG. 20D, structural truss module 610D employs groups 671, 672, 673, 674 . . . of four fasteners 640. Each of the groups of fasteners preferably engages the chords equidistantly spaced from the medial line l of the chords.

It will be appreciated that other structural truss module configurations are possible and that it is possible for a given truss module to employ one or more groups of two, three, four or a single fastener in a given truss module to provide the requisite structural strength. The illustrated modules 610A, 610B, 610C and 610D are intended to be representative and typically are longer and have many more fastener groups than depicted. The fasteners 640 preferably have a geometry substantially similar to fasteners 40 or 40'.

The structural truss modules 10, 510, 610A and 610D have a number of features. Each module is relatively open and consequently provides enhanced space for accommodating mechanical and electrical systems. The metal fasteners combine to implement a construction which has a high degree of structural integrity. The structural truss modules 10 have superior fire damage characteristic by virtue of a favorable anti-burn rate since the web connection, which provides the principal support, is the last structure to be adversely impacted by fire.

The structural truss modules 10, 510, 610A and 610D have a very favorable weight and provide enhanced storage capabilities since the components are essentially the chords plus the fasteners, and the various extra weight and storage requirements for the additional wood components characteristic of conventional truss construction are not present.

The fastener web 30 construction is relatively straightforward and can be accomplished in an efficient custom manner which lends itself to essentially just-in-time construction. The fastener web structure provides a conducive structure for attaching the various electrical plumbing and mechanical components by plastic ties and other efficient low cost mounting hardware. The disclosed structural truss modules are also greener in the sense that the only wood required for the module is the chords. Finally, the structural truss modules have favorable cost characteristics because the fastening components are typically less expensive than the conventional wood/lumber support components. In addition, the manufacturing process is less labor intensive.

Figure 3:
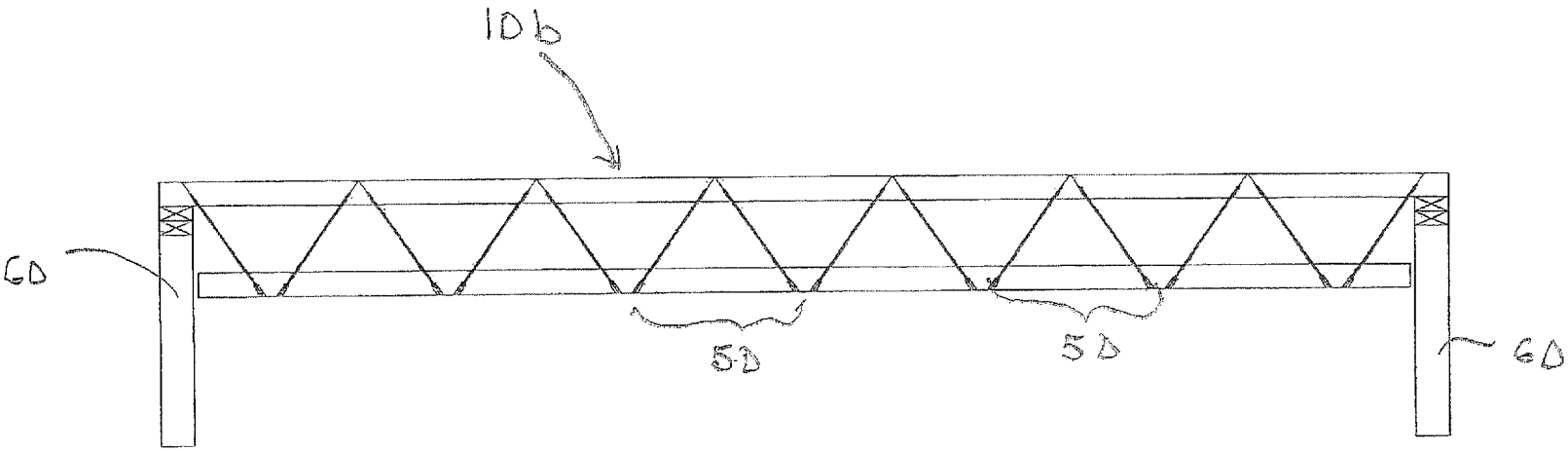
FIG. 3 is a side elevational view, partly in section, of a roof or floor truss module installed at a construction site.
Figure 6:
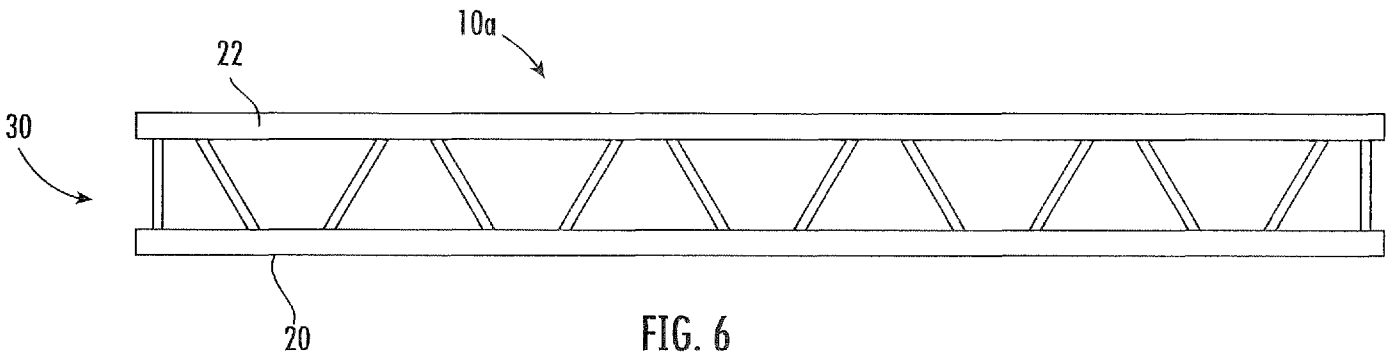
FIG. 6 is a side elevational view of another roof or floor truss module.

The structural truss components can be constructed in various lengths such as, for example, a smaller length for structural truss module 10*a* illustrated in FIG. 6, and in various configurations such as the flat truss 10*b* of FIG. 3 as mounted to support walls 60.

Figures 13A, 13B:
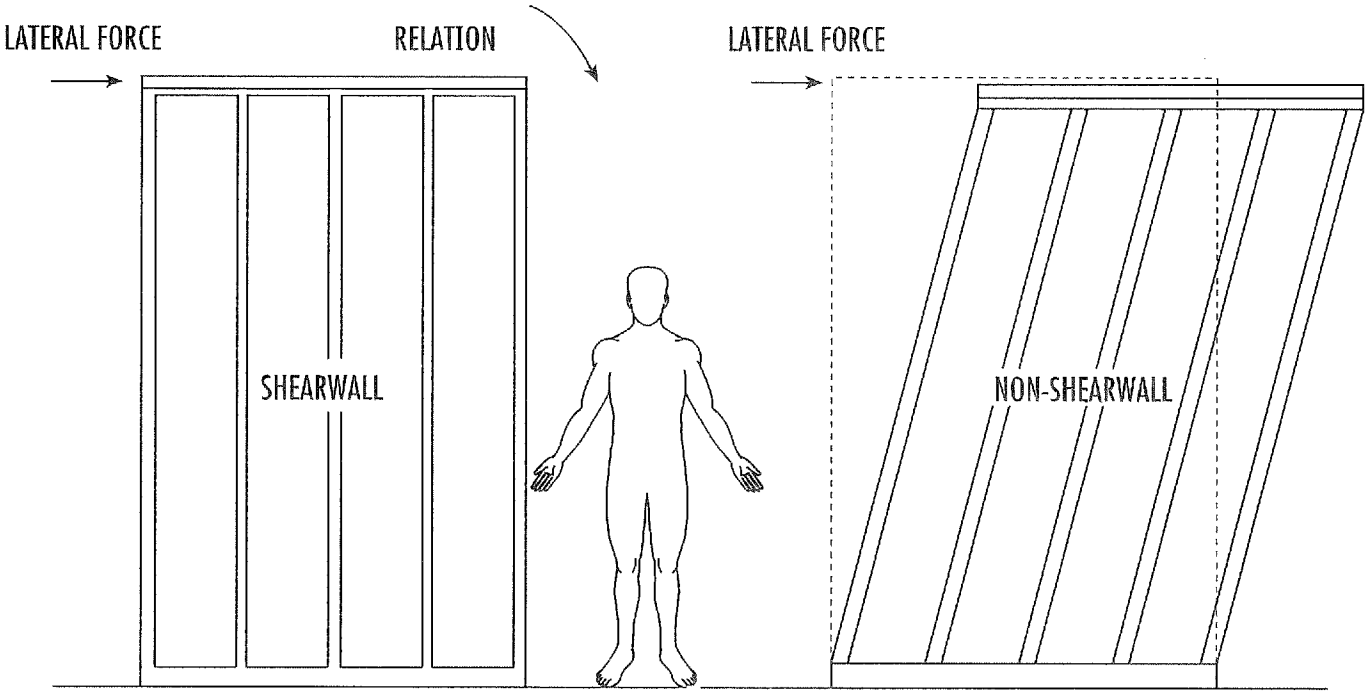
FIG. 13B PRIOR ART
FIG. 13A is a side elevational view, partly in schematic, of a prior art shear wall diagram.
FIG. 13B is a side elevational view of a prior art wall diagram illustrating non-shear characteristics upon an application of a lateral force.
Figure 14:
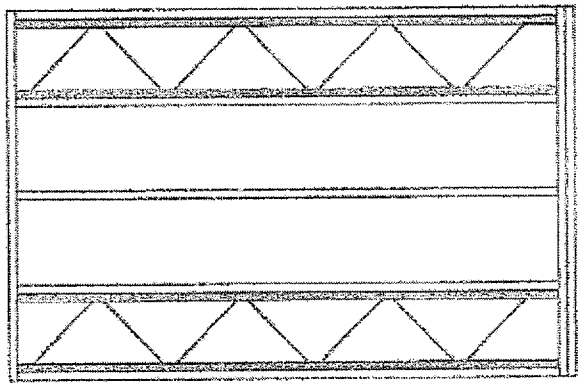
FIG. 14 is a side elevational view of a shear wall incorporating installed shear panels comprising structural truss modules employing a web of fasteners.
Figure 15:
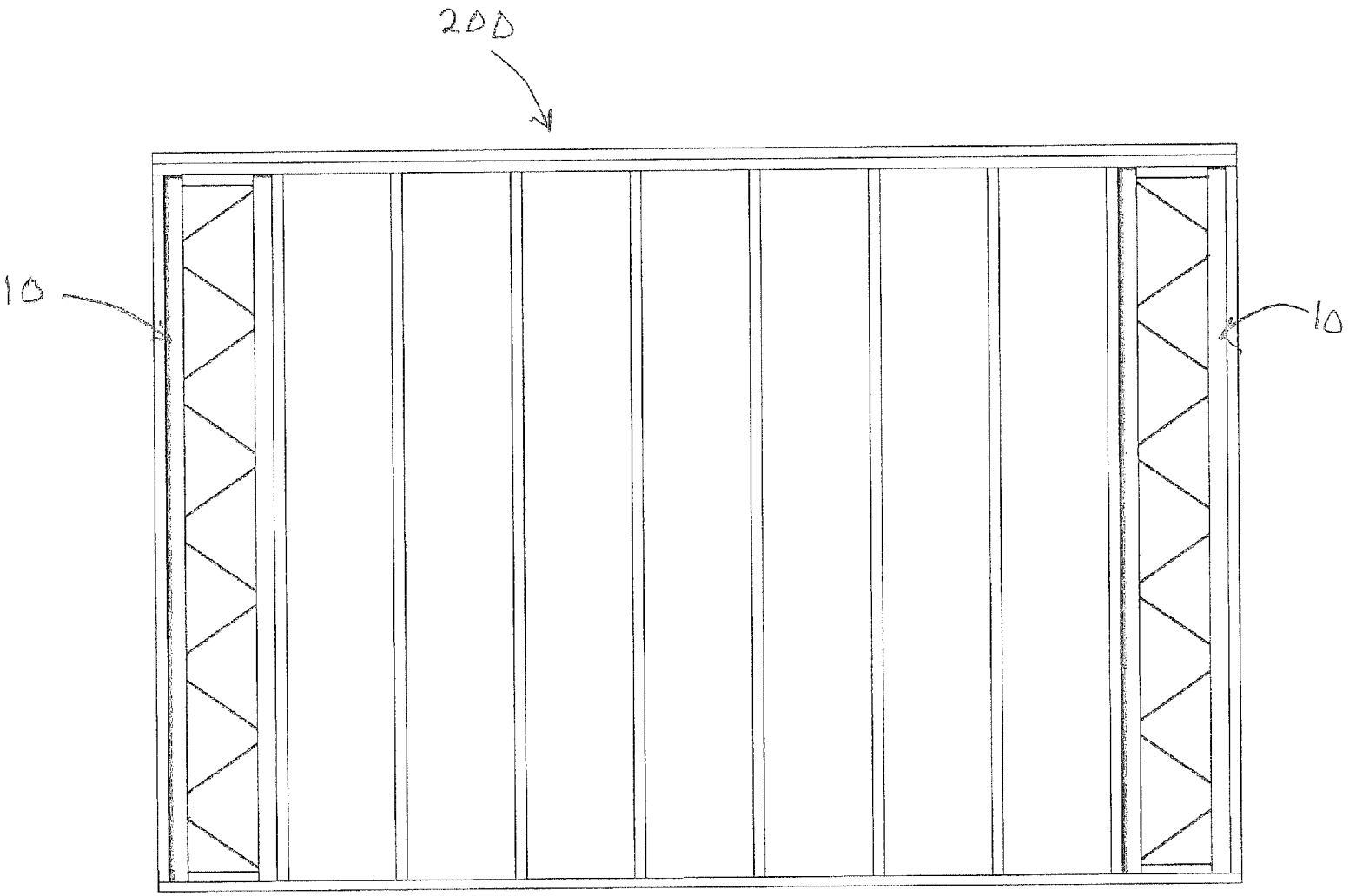
FIG. 15 is a side elevational view illustrating structural truss modules employed as vertical shear panels in a wall.
Figure 16:
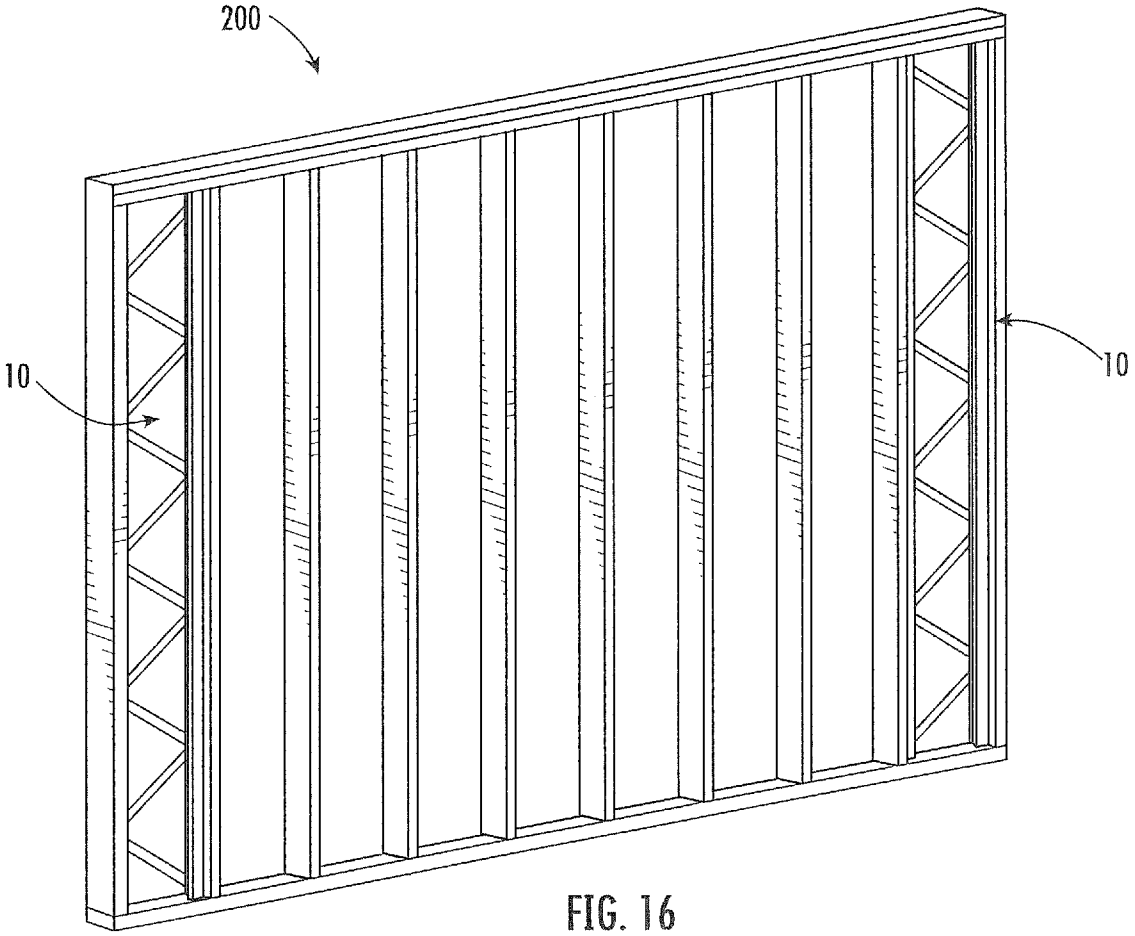
FIG. 16 is a perspective view of a wall incorporating shear panels comprising the structural truss modules of FIG. 15.

With reference to FIGS. 14-16, the structural truss modules 10 also have applicability as reinforcing panels for shear walls 200. In this context, the modules are oriented vertically. FIGS. 13A and 13B illustrate a prior art conventional shear wall which, upon subject to a lateral force, such as wood, tends to rotate. The incorporation of the structural truss modules reinforces the wall and tends to make the wall resistant to application of a lateral shear force and consequent rotation as illustrated in FIG. 13B. FIGS. 15 and 16 illustrate an alternative implementation of the structural truss module 10 to construct the shear wall 200.

Figure 17:
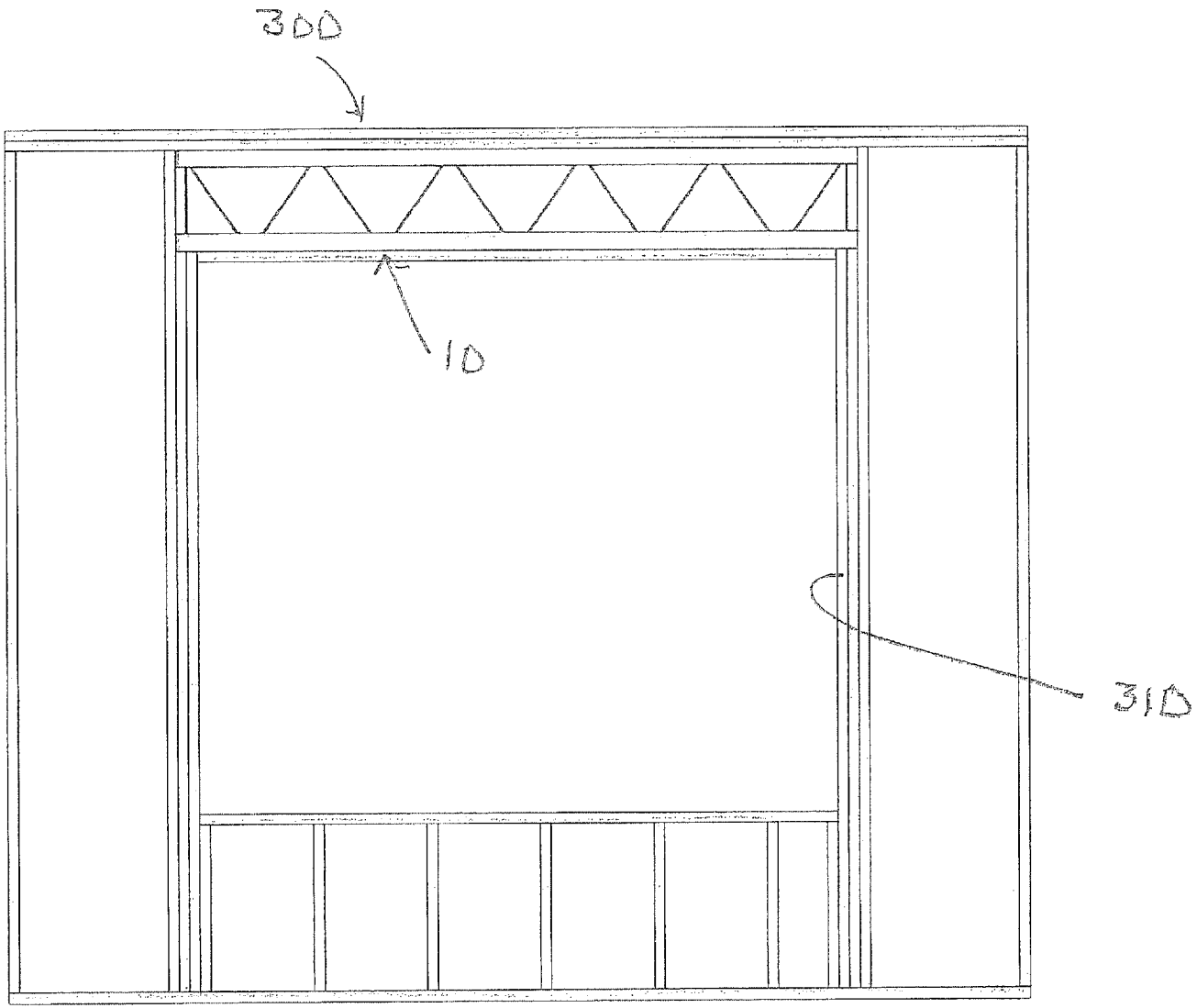
FIG. 17 is a side elevational view illustrating an installed header comprising a structural truss module with a web of fasteners.
Figure 18:
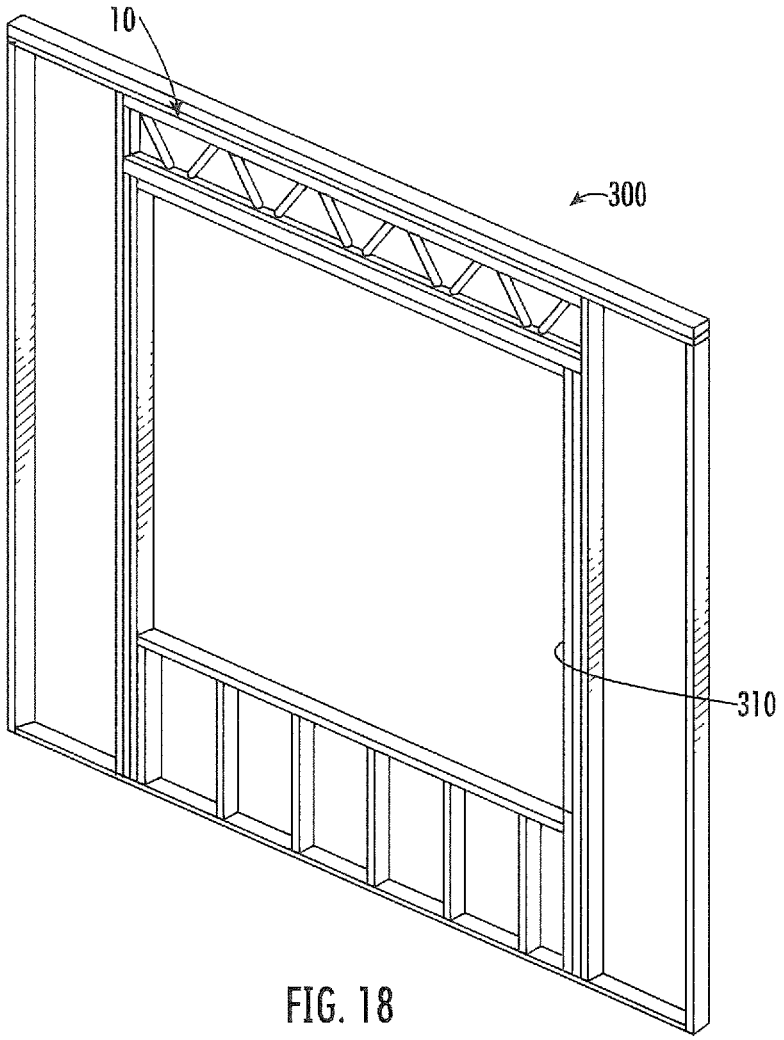
FIG. 18 is a perspective view of the header wall assembly of FIG. 17.

With reference to FIGS. 17 and 18, the structural truss module 10 also can be employed as a header over a window or doorway 310 or other structure for wall 300. In this regard, the module has a horizontal orientation. The construction of the module can be custom completed for a given construction application. Again, the header provides enhanced support. Due to its openness, the structural truss module 10 header provides improved thermal capabilities by enhancing the insulation and airtightness of the construction as a consequence of inserting insulation materials into the open structure of the module.

Naturally, truss modules 610A-610D may also be employed for support walls, shear walls and headers.

Figure 21:
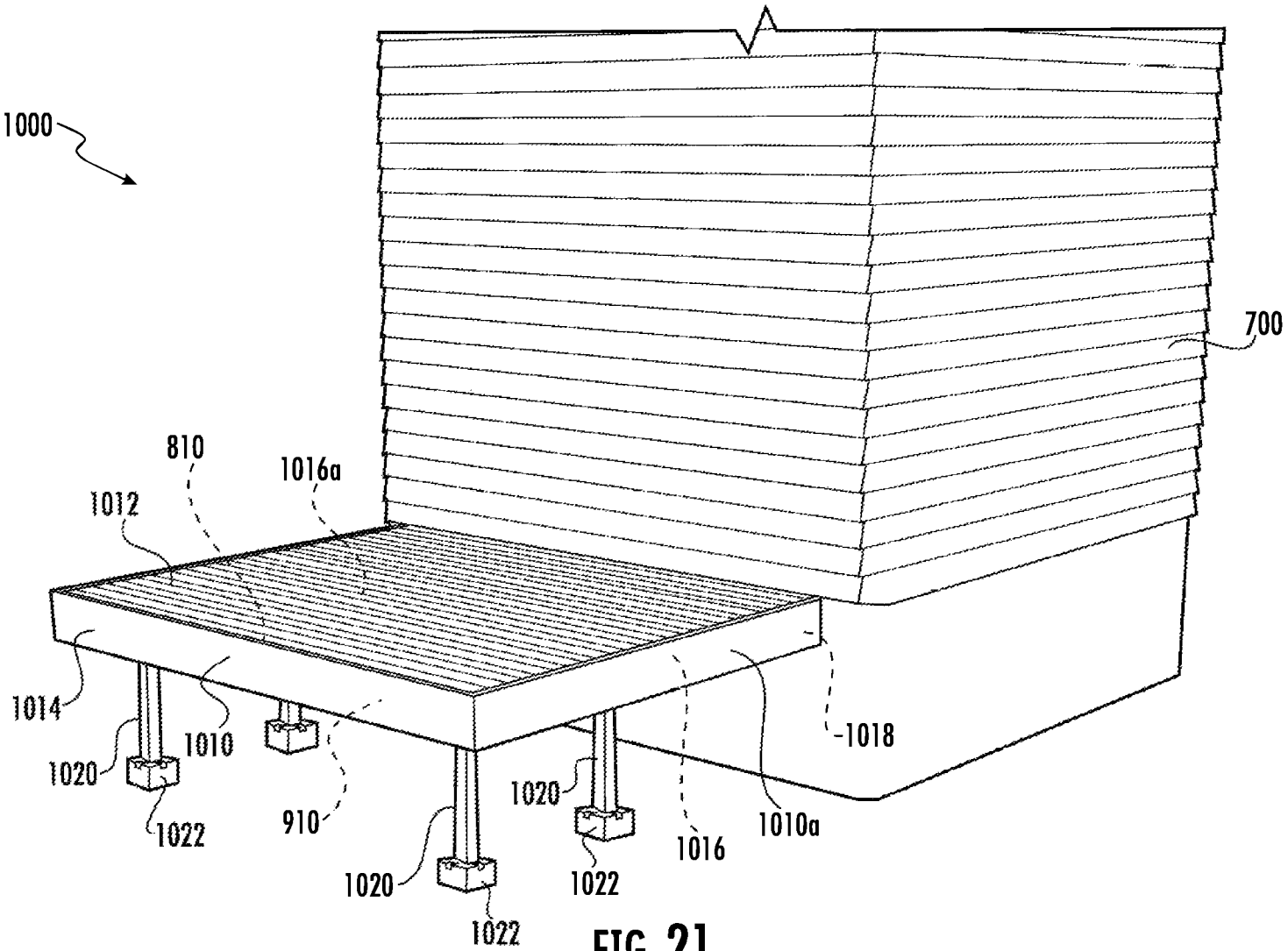
FIG. 21 is a perspective view of a modular building structure incorporating features of the present disclosure.

With reference to FIG. 21, there is shown a perspective view of a structure 700 with a modular deck 1000 attached thereto. The structure 700 may be a house, building, or any other structure capable of having a deck or platform extend therefrom.

The modular deck (or modular building structure) 1000 is formed from a plurality of truss modules 810 (best seen in FIG. 24) which serve a similar function as joists in a conventional deck configuration. The modular deck 1000 (comprising the plurality of truss modules 810) provides a replacement configuration for conventional joist and blocking decking arrangements (see FIG. 22). The joist and blocking arrangements for conventional deck structures generally includes joists which are connected to a ledger by joist hangers, and blocking (between the joists) which is provided by several separate members installed between the joists. The conventional joists generally comprise dimensional lumber sizes of 2×6, 2×8, 2×10, or 2×12, and the blocking comprises suitably sized dimensional lumber fitted between the joists. The features of the modular deck 1000 allow for faster assembly/construction, increased durability, and other efficiencies over the conventional configurations, as will be described below.

Each one of the structural truss modules 810 is similar to the structural truss module 10 such that the lower chord 820, the upper chord 822, and the fasteners 840 are substantially the same as the lower chord 20, the upper chord 22, and the fasteners 40. According to various exemplary embodiments, the structural truss modules 810 are preassembled at a manufacturing facility or other suitable location capable of assembling the structural truss modules as described above.

While the modular deck 1000 has been described in connection with the truss module 810 (which is similar to the truss module 10), it should be noted that in alternate embodiments the modular deck may comprise any other suitable structural truss module (such as the truss modules 510, 610A, 610B, 610C, 610D, for example).

In addition to the truss modules 810, the modular deck 1000 comprises rim fascia members 1010, 1010*a*, decking members 1012, outer fascia members 1014, and blocking members 1016, 1016*a*. The modular deck is configured to be attached to a ledger 1018 and is supported by one or more carrying beam truss modules 910 which are attached to support posts 1020 and corresponding footings 1022.

Figure 23:
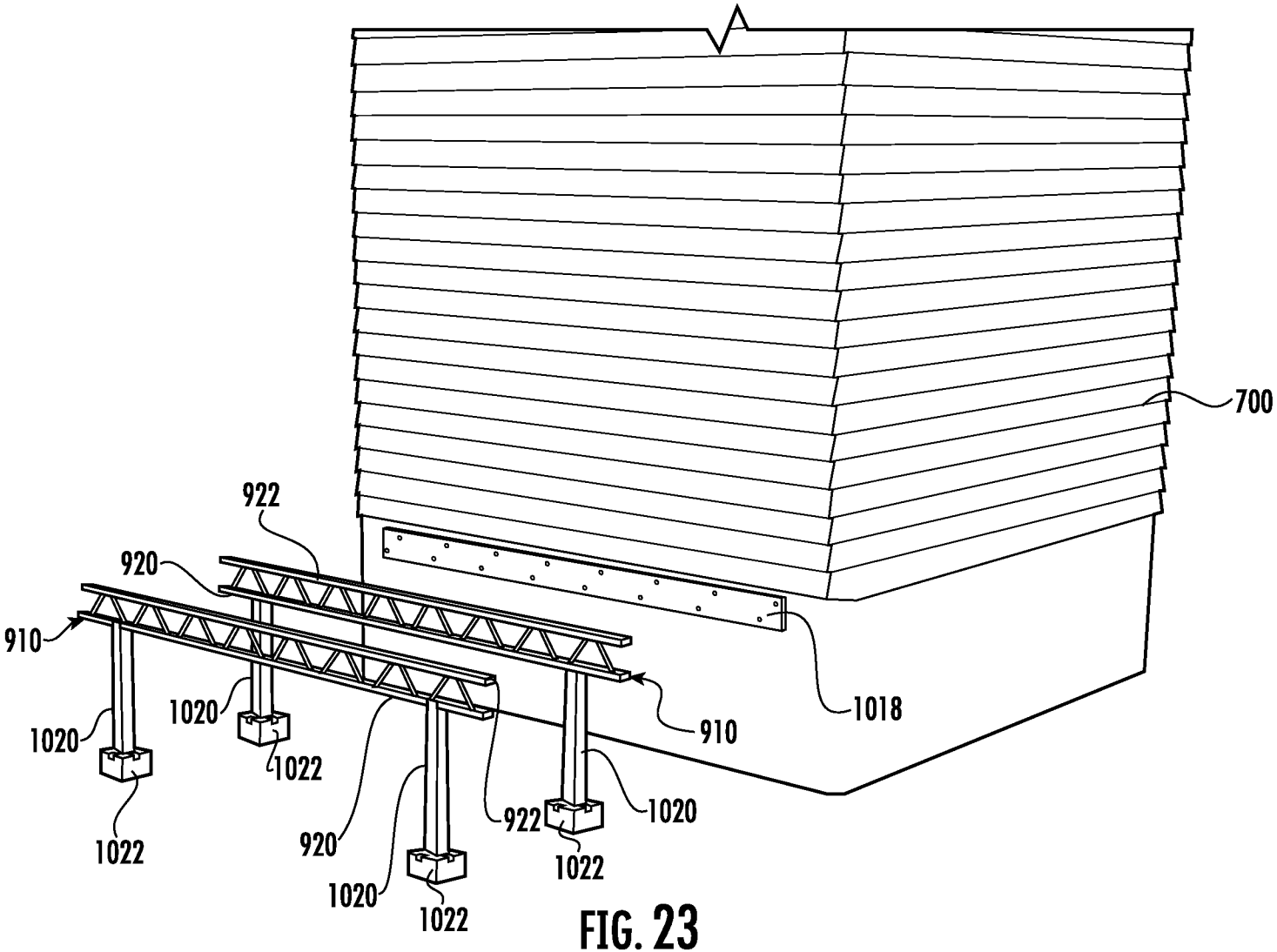
FIG. 23 is a perspective view of a ledger, carrying beam truss modules, support posts, and footings used in the modular building structure shown in FIG. 21.

Referring now also to FIG. 23, there is shown the ledger 1018 attached to the structure 700 and two carrying beam truss modules 910. Each one of the carrying beam truss modules 910 is similar to the 'double fastener' structural truss module 610B such that the lower chord 920, the upper chord 922, and the fasteners 940 are substantially the same as the lower chord 620, the upper chord 622, and the fasteners 640. Similar to the structural truss modules 810, the carrying beam truss modules 910 are preassembled at a manufacturing facility or other suitable location capable of assembling the carrying beam modules as described above.

The carrying beam truss modules 910 are attached to the support posts 1020 which are secured to the footings 1022. According to some embodiments, the carrying beam truss modules 910 may be temporarily attached to the support posts 1020 during assembly of the deck 1000 such as to allow for spacing of the structural truss modules 810 (with the carrying beam truss modules 910 securely attached [with suitable fasteners, for example] to the support posts 1020 upon completion of assembly). The ledger 1018 provides a mounting and support area between the structure 700 and the deck 1000. The carrying beam truss modules 910 provide support for the remainder of the deck at spaced intervals from the ledger 1018.

According to various exemplary embodiments carrying beam truss modules 910 (which are similar to the truss module 610B) are provided as shown in FIG. 23, however in other embodiments any suitable type of truss module may be provided (such as truss modules 10, 510, 610A, 610C, 610D, for example). Additionally, although FIG. 23 shows two carrying beam truss modules for supporting the deck, any suitable number of carrying beam truss modules (such as one or three, for example) may be provided for supporting the deck.

Figure 24:
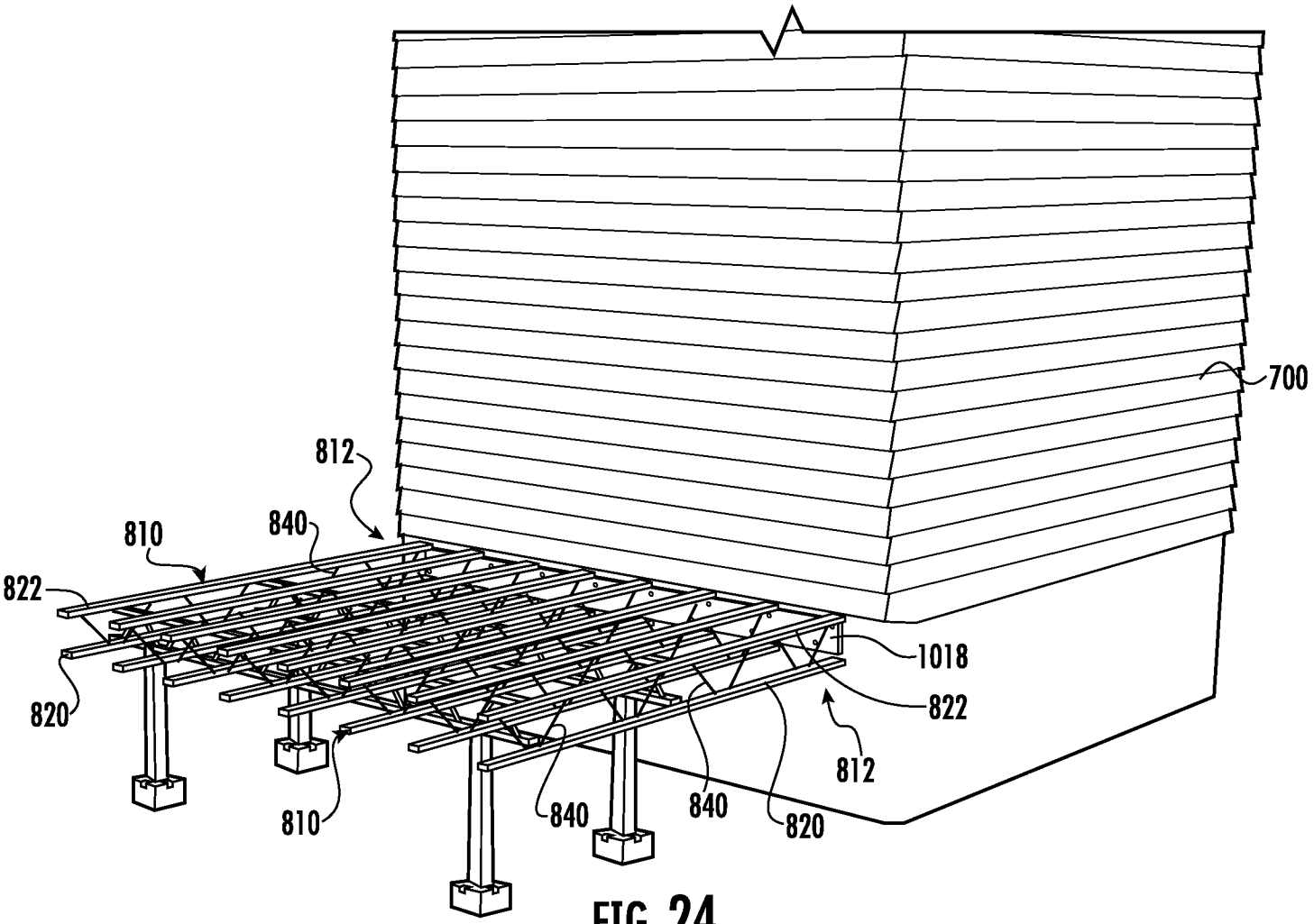
FIG. 24 is a perspective view of arranged structural truss modules the modular building structure shown in FIG. 21.
Figure 25:
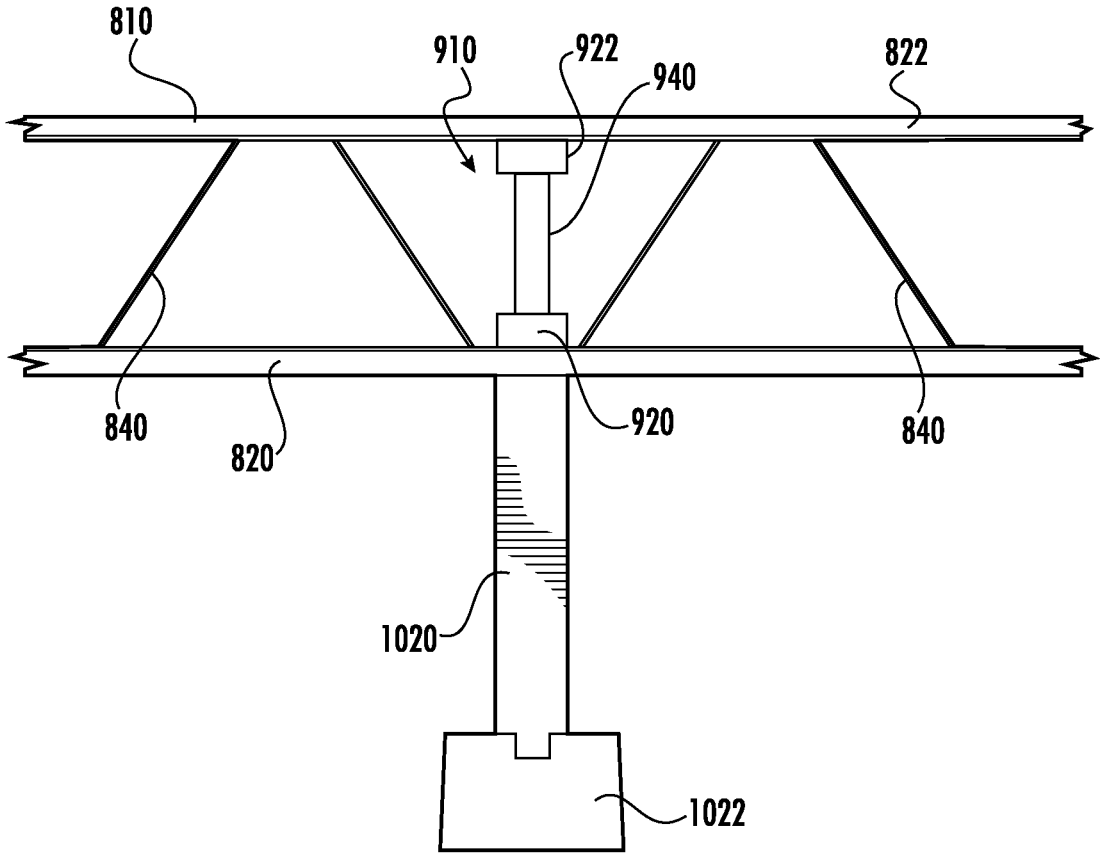
FIG. 25 is a side view of a portion the modular building structure shown in FIG. 21 further illustrating a carrying beam truss module.

The preassembled structural truss modules 810 are arranged in a general parallel fashion and are spaced apart at about 12-24 inches similar to conventional joists (see FIG. 24). The structural truss modules 810 are substantially perpendicular to the carrying beam truss modules 910 which are suitably spaced from each other. The structural truss modules 810 are arranged such that lower chords 920 and upper chords 922 of the carrying beam truss modules 910 extend between the lower chords 820 and the upper chords 822 of the structural truss modules 810 (as best seen in FIGS. 24 and 25).

Figure 26:
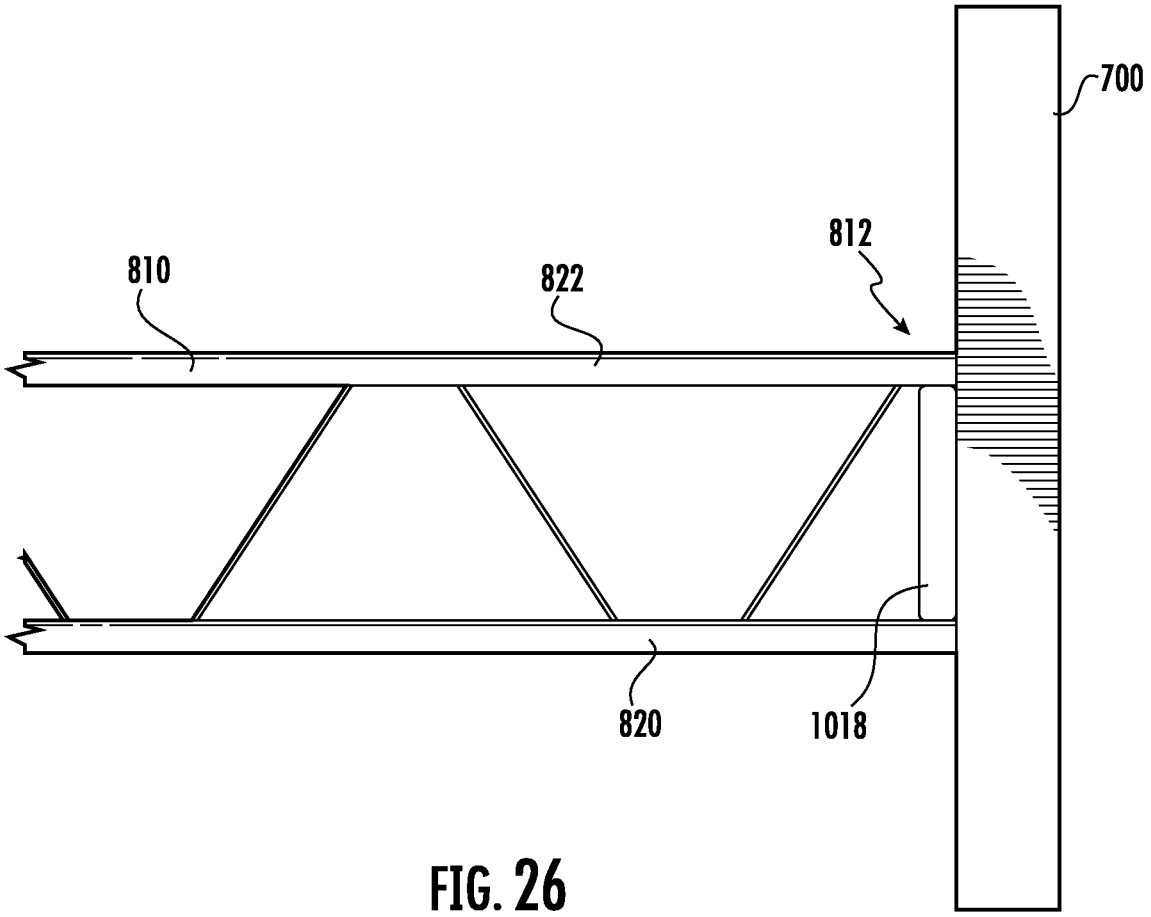
FIG. 26 is a side view of a portion the modular building structure shown in FIG. 21 further illustrating attachment to a ledger.

First ends 812 of the structural truss modules 810 are directly attached to the ledger 1018 such that the leger is received between the bottom chords 820 and the upper chords 822 (best seen in FIG. 26). With this configuration, the chords 820, 822 can be secured to the ledger 1018 by any suitable fastener (without the need for a joist hanger).

Figure 27:
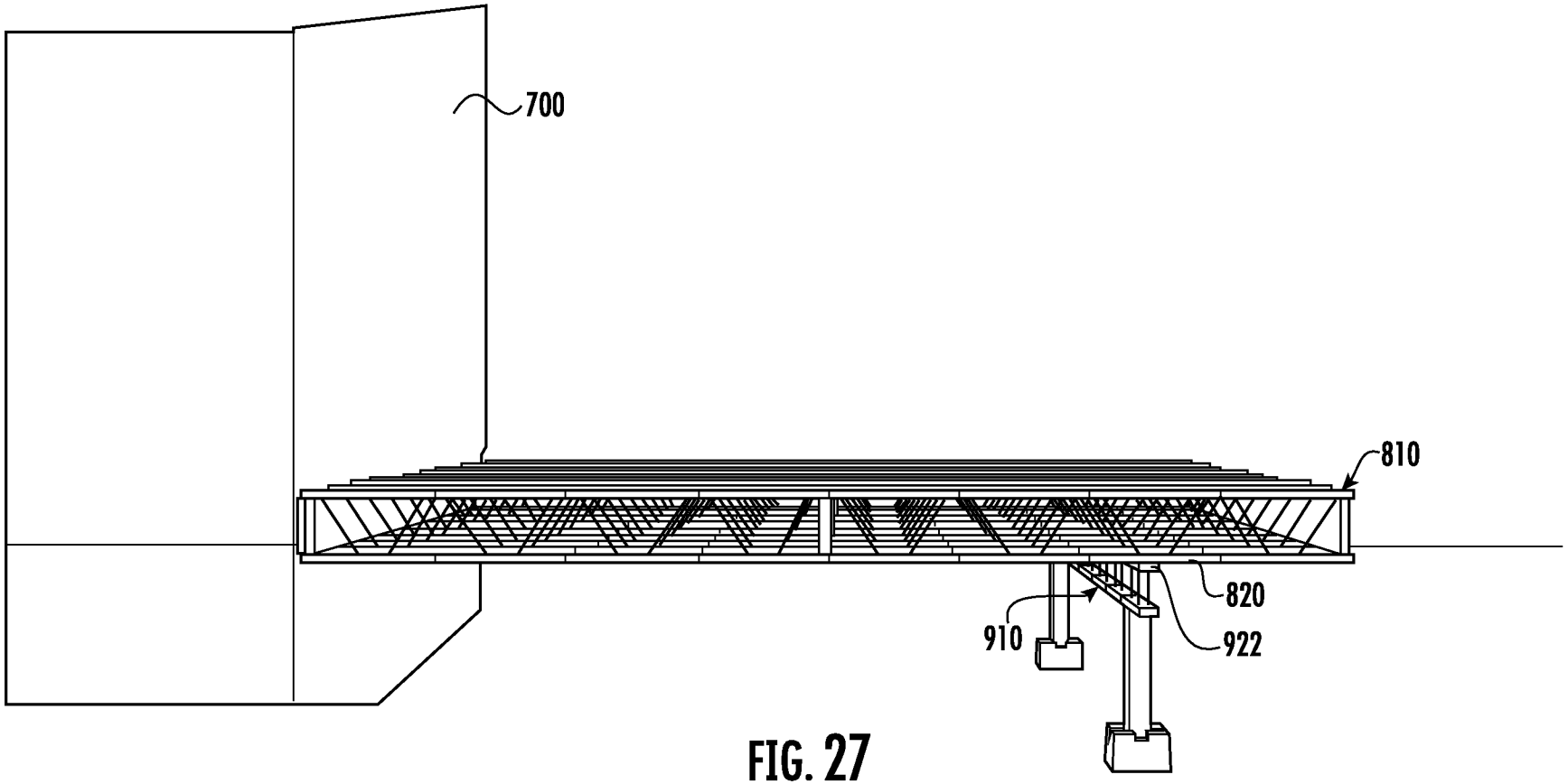
FIG. 27 is a side view of the modular building structure with an alternate arrangement for the carrying beam truss module.

Support for the remaining length of the structural truss modules 810 extending from the leger 1018 is provided by the carrying beam truss modules 910. Although the embodiment shown in FIG. 24 shows the carrying beam truss modules 910 extending between the chords 820, 822 of the truss modules 810, alternate embodiments may comprise one or more of carrying beam truss modules 910 below the structural truss modules 810 as shown in FIG. 27. In this embodiment, a portion of the bottom surfaces of the lower chords 820 of the structural truss modules 810 rest on a top surface of the upper chord 922 of the carrying beam truss module 910.

Figure 22:
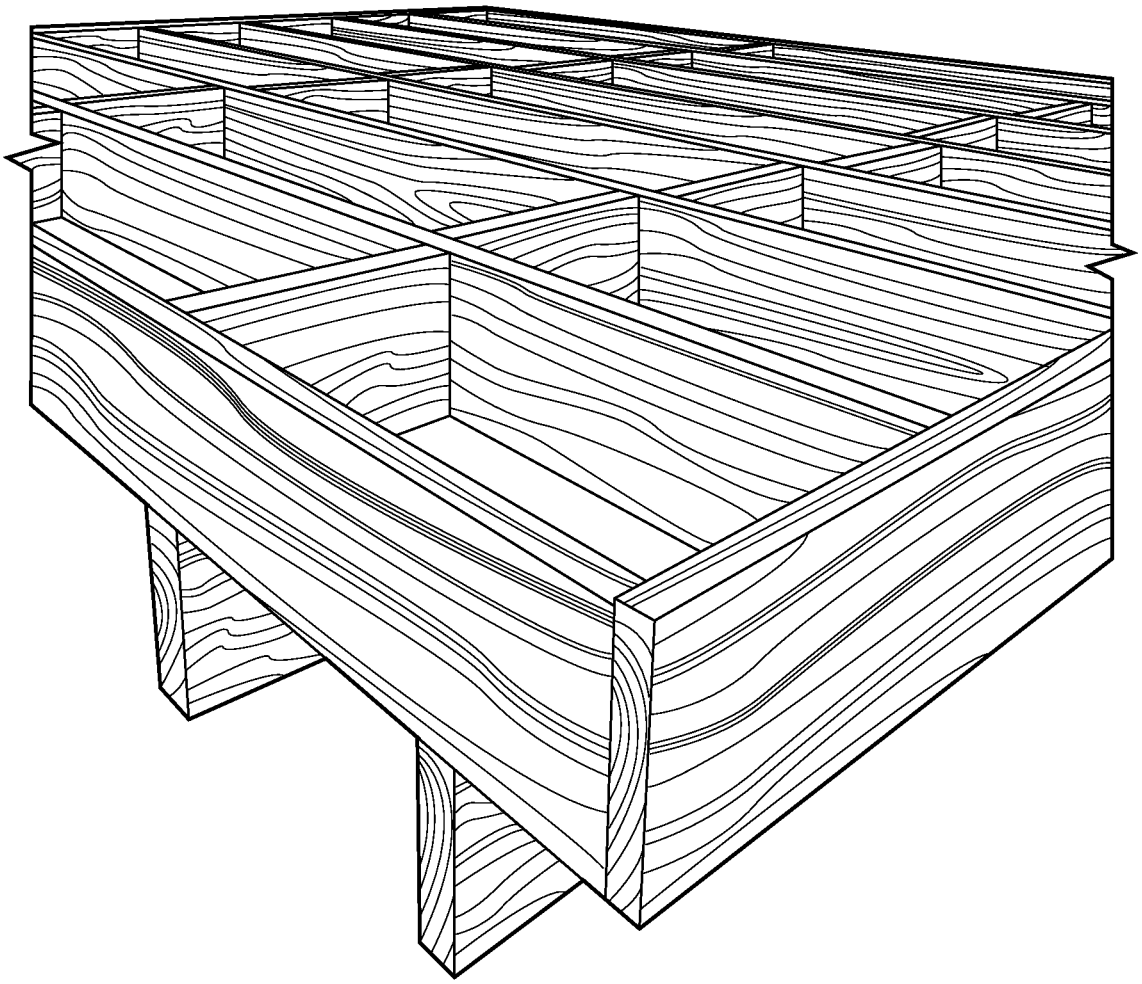
PRIOR ART FIG. 22
FIG. 22 is a perspective view of a prior art decking structure.
Figure 28:
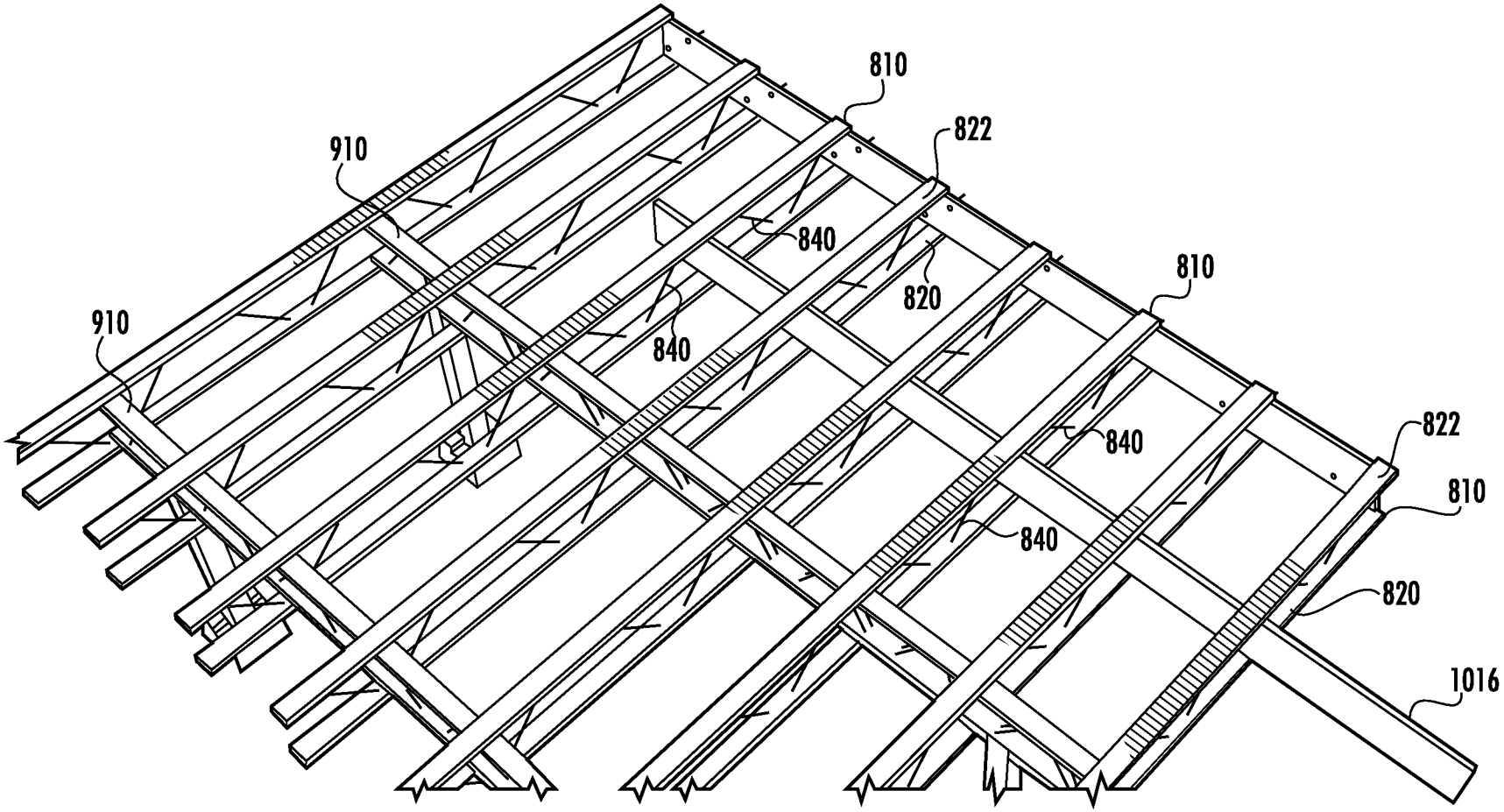
FIG. 28 is a perspective view illustrating insertion of a blocking member used in the modular building structure shown in FIG. 21.

Referring now also to FIG. 28, one or more of the blocking members 1016 may be provided between the fasteners 840 such that each blocking member is received between the bottom chords 820 and the upper chords 822 of the structural truss modules 810. Similar to conventional blocking (as shown in FIG. 22), the blocking members 1016 provide additional support to stiffen the deck 1000. According to various exemplary embodiments, each blocking member may be an integral one piece member, suitably sized and shaped to extend in a substantially perpendicular orientation relative to the structural truss modules.

Figure 29:
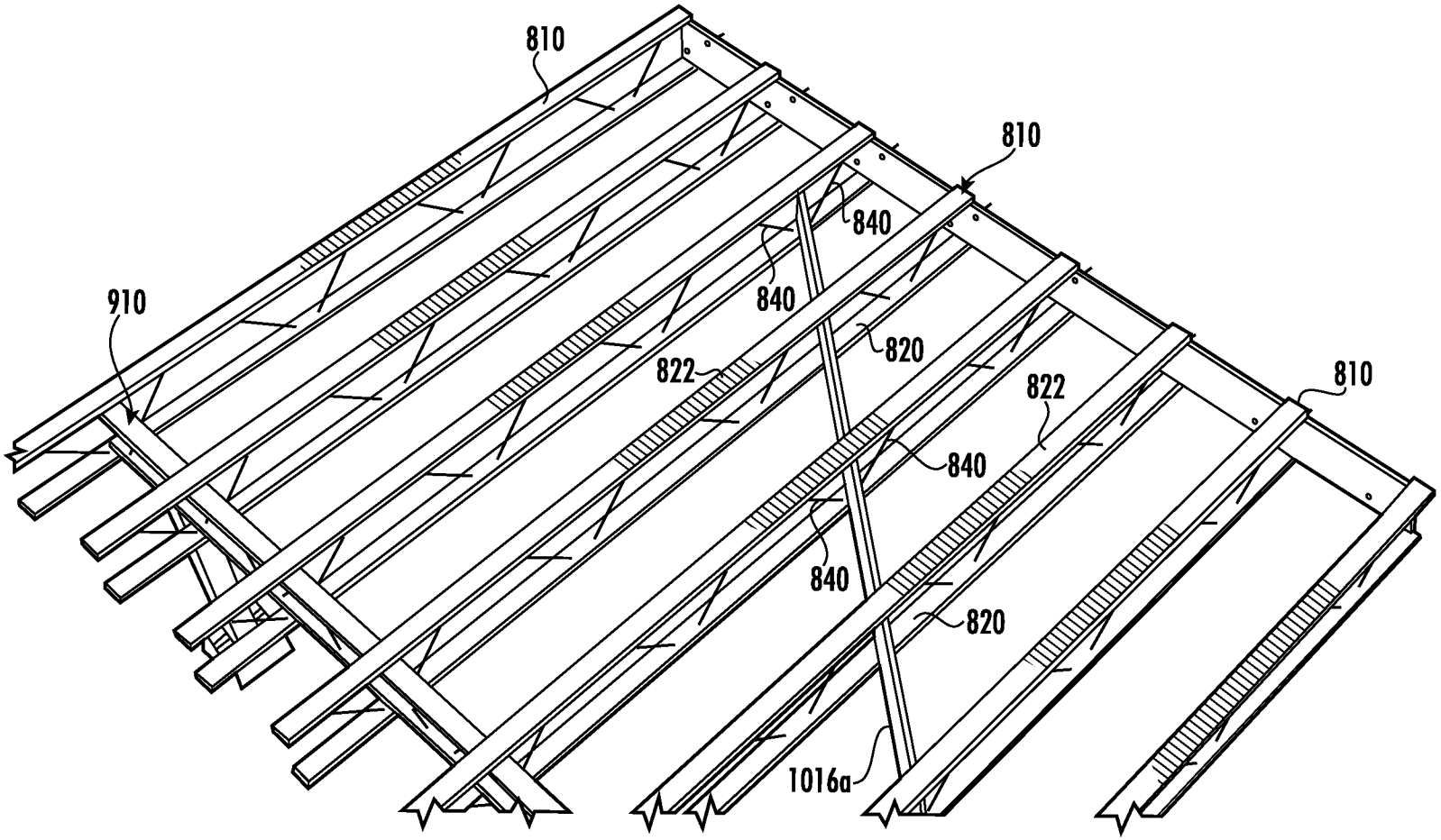
FIG. 29 is a perspective view illustrating insertion of a cross bracing blocking member used in the modular building structure shown in FIG. 21.

With the open structure of the structural truss modules 810, one or more of the blocking members may be provided at an angled orientation relative to the structural truss modules. For example FIG. 29 shows a blocking member 1016*a* extending between the fasteners 840 but angled relative to the structural truss modules 810. Similar to the blocking member 1016, the blocking member 1016*a* comprises an integral one piece member suitably sized and shaped to extend between the lower chords 820 and the upper chords 822 of the structural truss modules 810.

Figure 30:
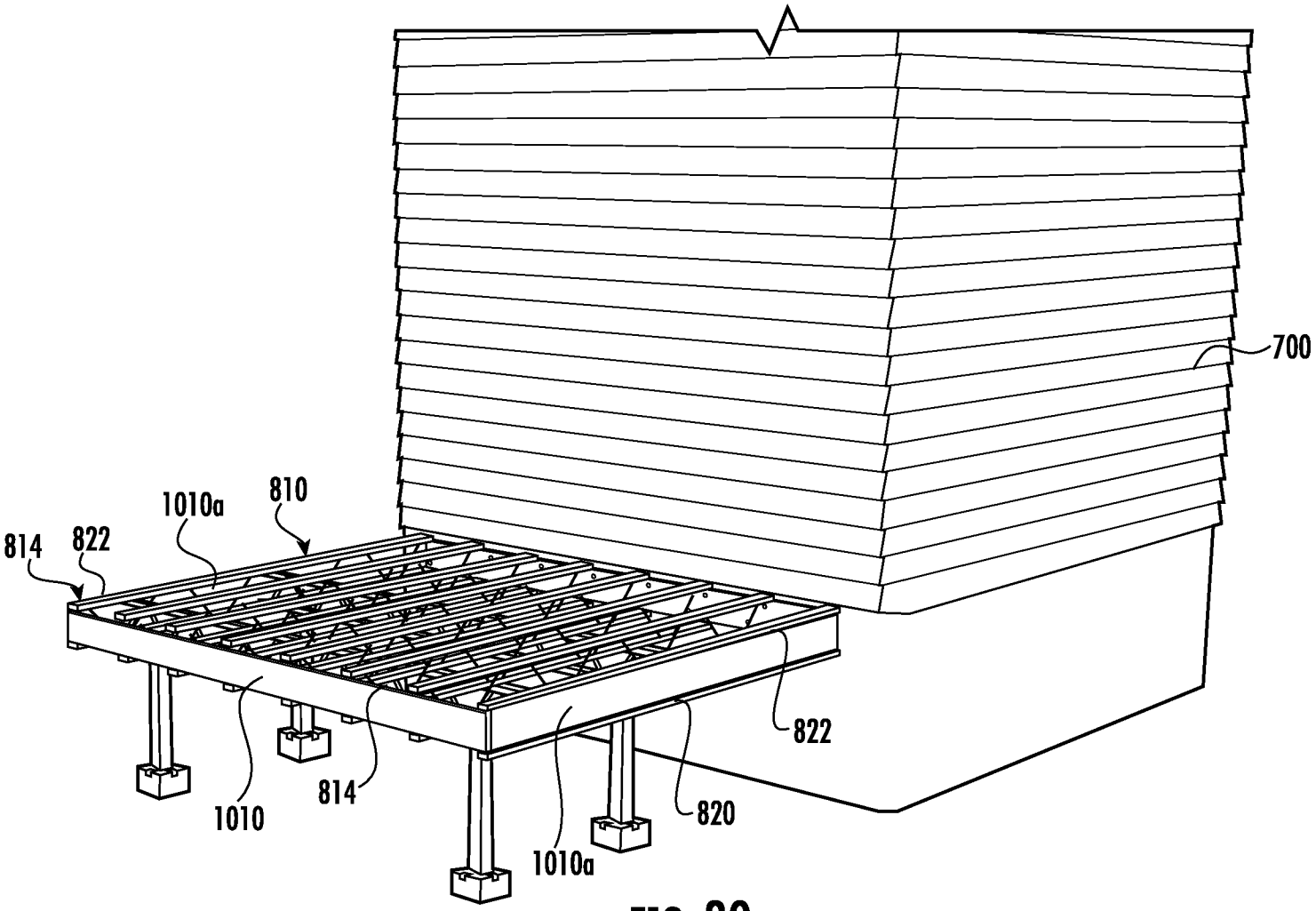
FIG. 30 is a perspective view illustrating attaching of rim fascia members used in the modular building structure shown in FIG. 21.
Figure 31:
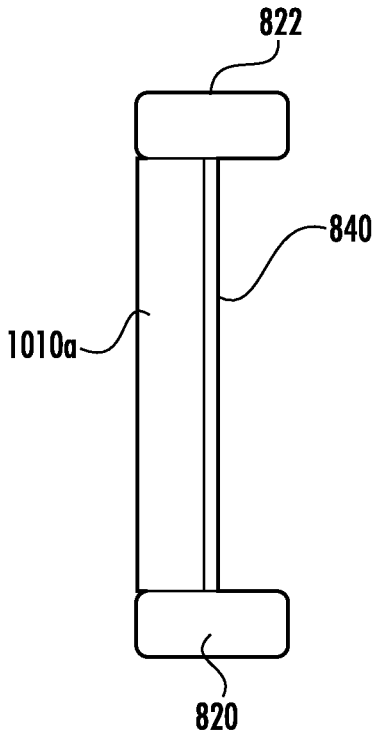
FIG. 31 is a front view of one of the rim fascia members (attached to a structural truss module) shown in FIG. 30.

The rim fascia members 1010, 1010*a* extend between the lower chords 820 and the upper chords 822 of the structural truss modules 810 proximate outer edges of the modular deck 1000. One of the rim fascia members 1010 extends between the chords 820, 822 at second ends 814 of the structural truss modules 810 such that the rim fascia member 1010 is perpendicular to the structural truss modules and opposite the ledger (see FIG. 30). The other rim fascia members 1010*a* extend between the chords 820, 822 such that the rim fascia members 1010*a* are parallel to the structural truss modules 810 and adjacent to the fasteners 840 such that top and bottom sides of the rim fascia members are between the chords (see FIGS. 30, 31).

Figure 32:
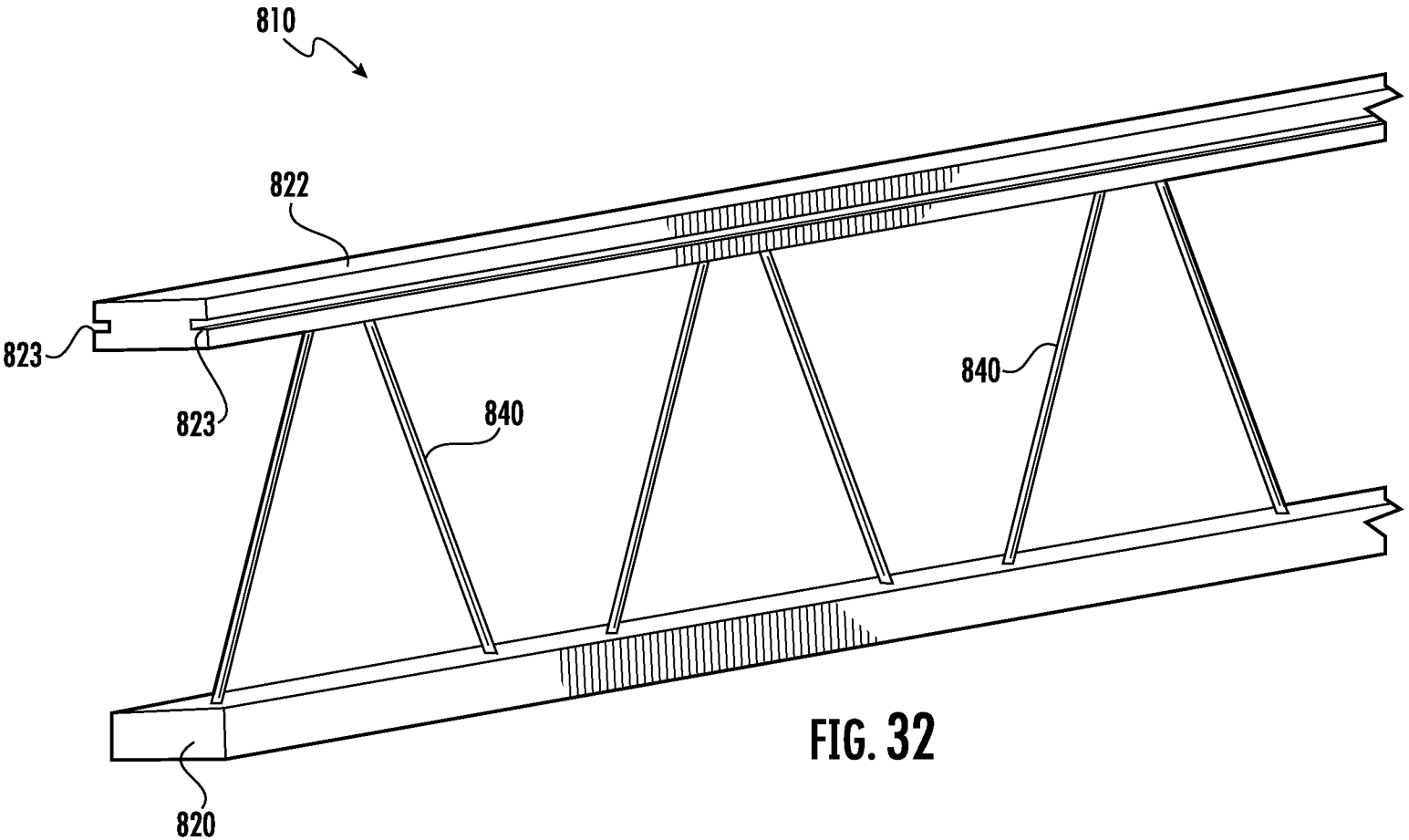
FIG. 32 is a perspective view of a structural truss module having a grooved top chord.

As shown in FIG. 21, the decking members 1012 are attached to the top side of the top chords by screws or by any other suitable fastening method. The decking members 1012 are generally arranged to be perpendicular to the structural truss modules 810, however any suitable arrangement may be provided. According to some alternate embodiments, the decking members 1012 are attached to the top side of the top chords 1022 by a decking bracket or any other suitable complementary hardware or fastener (not shown). In these alternate embodiments, the top chords 1022 comprise grooves 823 configured to receive portions of the decking bracket (see FIG. 32). Also shown in FIG. 21, the outer fascia members 1014 are attached over the rim fascia members by screws or any other suitable fastening method.

According to various exemplary embodiments, the structural truss modules 810 are preassembled and may be provided as a standard size, or may be cut to size (if needed) corresponding to the particular size required for the application (such as deck, for example). The preassembly and/or cutting of the structural truss modules may be performed at a manufacturing facility or other suitable location capable of assembling and/or cutting the truss modules as described above.

Figure 33:
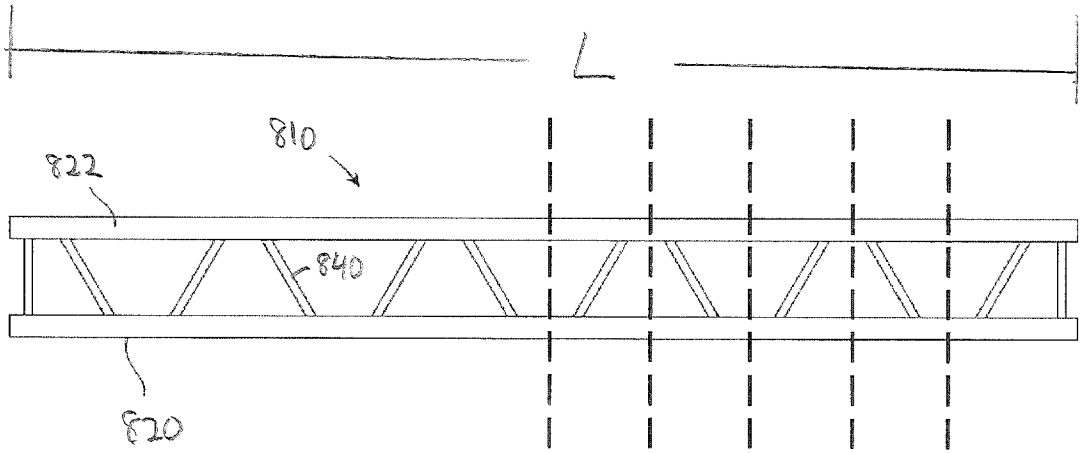
FIG. 33 is a side view of a structural truss module (with illustrated cut lines) used in the modular building structure shown in FIG. 21.

According to some exemplary embodiments, the structural truss modules can be delivered to the job site as a standard size and then cut to a custom size at the job site. For example see FIG. 33 which shows various cut lines (shown as dashed vertical lines along a length L) illustrating various locations along the length of the structural truss module where the structural truss module can be cut to the desired size. It should be noted that some embodiments may comprise vertical fasteners at opposite ends of the structural truss modules, however any suitable fastener configuration may be provided.

Figure 34:
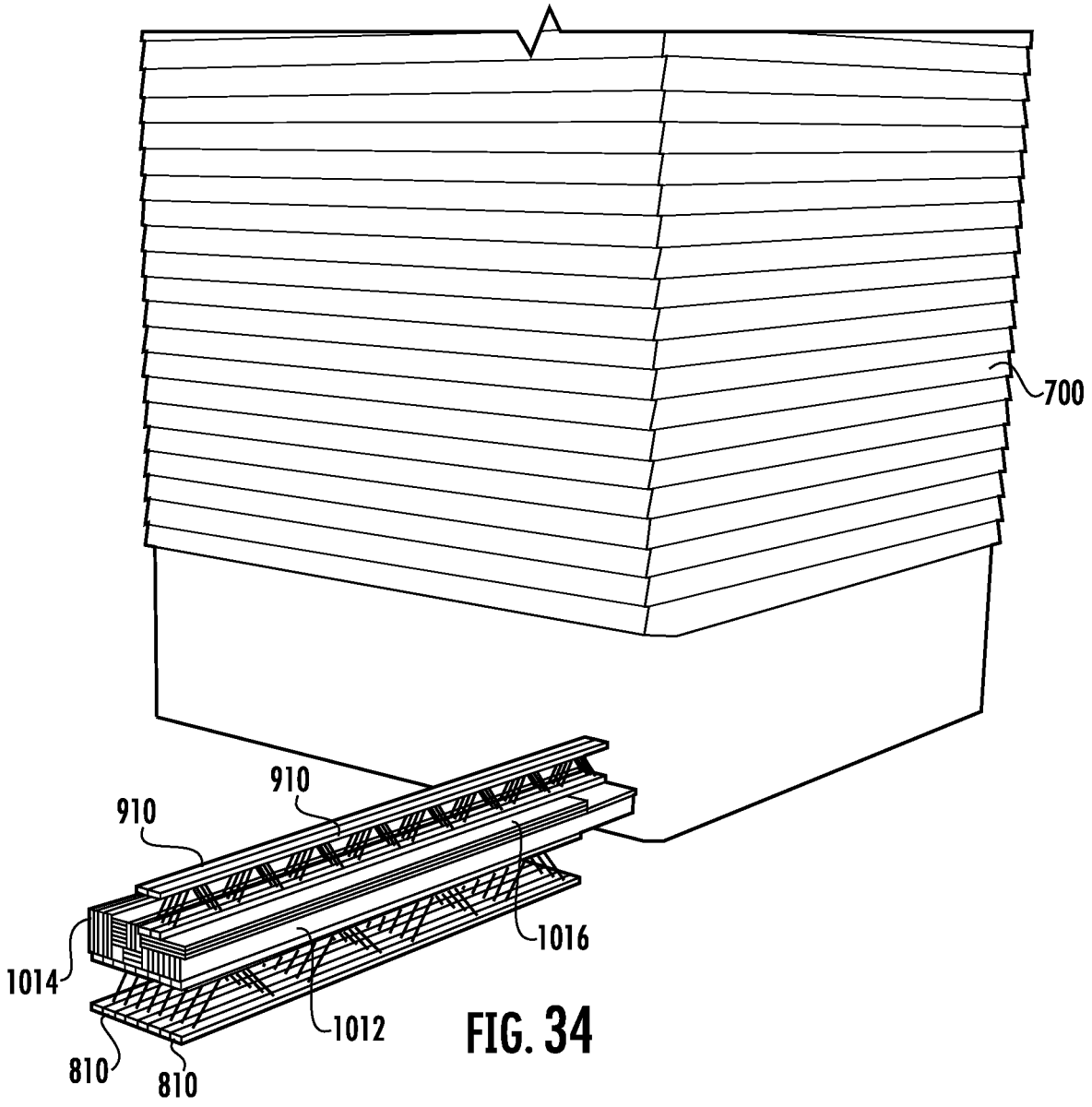
FIG. 34 is a perspective view of delivered materials used in the modular building structure shown in FIG. 21.

With the standard sizes and/or custom cut sizes of the structural truss modules and other building materials, this allows for compact decking materials to be transported to the job site with added ease of shipping, delivery, etc. For example, FIG. 34 illustrates exemplary delivered materials may be provided to a job site (which includes the decking components shown in FIG. 1 in a compact and delivered configuration). According to some embodiments, the structural truss modules may be already cut to size in a manufacturing facility, in other embodiments the structural truss modules may be a standard length which can be cut to size at the job site.

Figure 35:
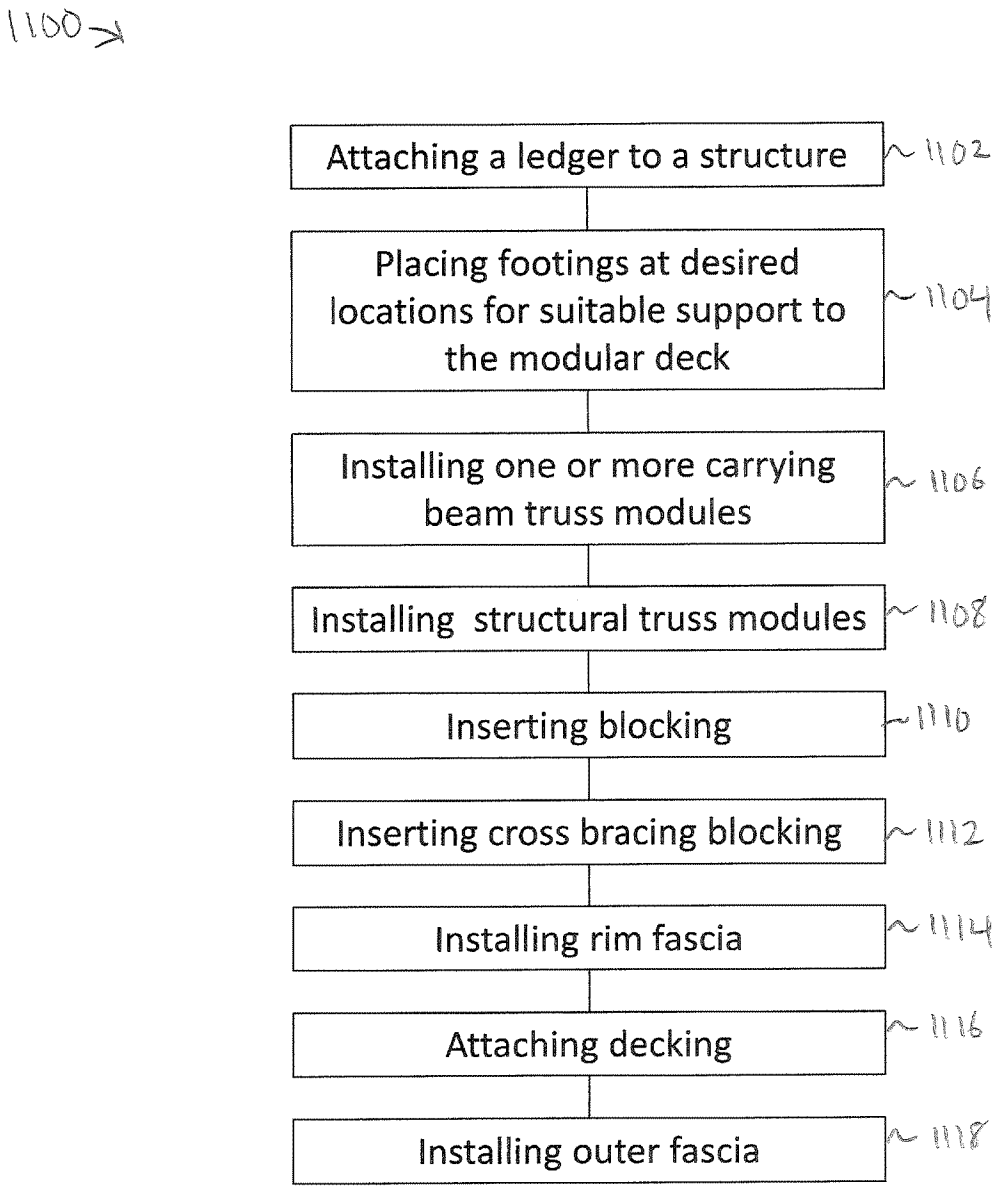
FIG. 35 is a block diagram of an exemplary method of the present disclosure.

With the delivered materials, the following method 1100 (illustrated in FIG. 35) may be provided. The method 1100 includes attaching a ledger to a structure (at block 1102). Placing footings at desired locations for suitable support to the modular deck (at block 1104). Installing one or more carrying beam truss modules (at block 1106). Installing structural truss modules (at block 1108). Inserting blocking (at block 1110). Inserting cross bracing blocking (at block 1112). Installing rim fascia (at block 1114). Attaching composite decking (at block 1116). Installing composite fascia (at block 1118). It should be noted that the illustration of a particular order of the blocks does not necessarily imply that there is a required or preferred order for the blocks and the order and arrangement of the blocks may be varied. Furthermore it may be possible for some blocks to be omitted.

Figure 36:
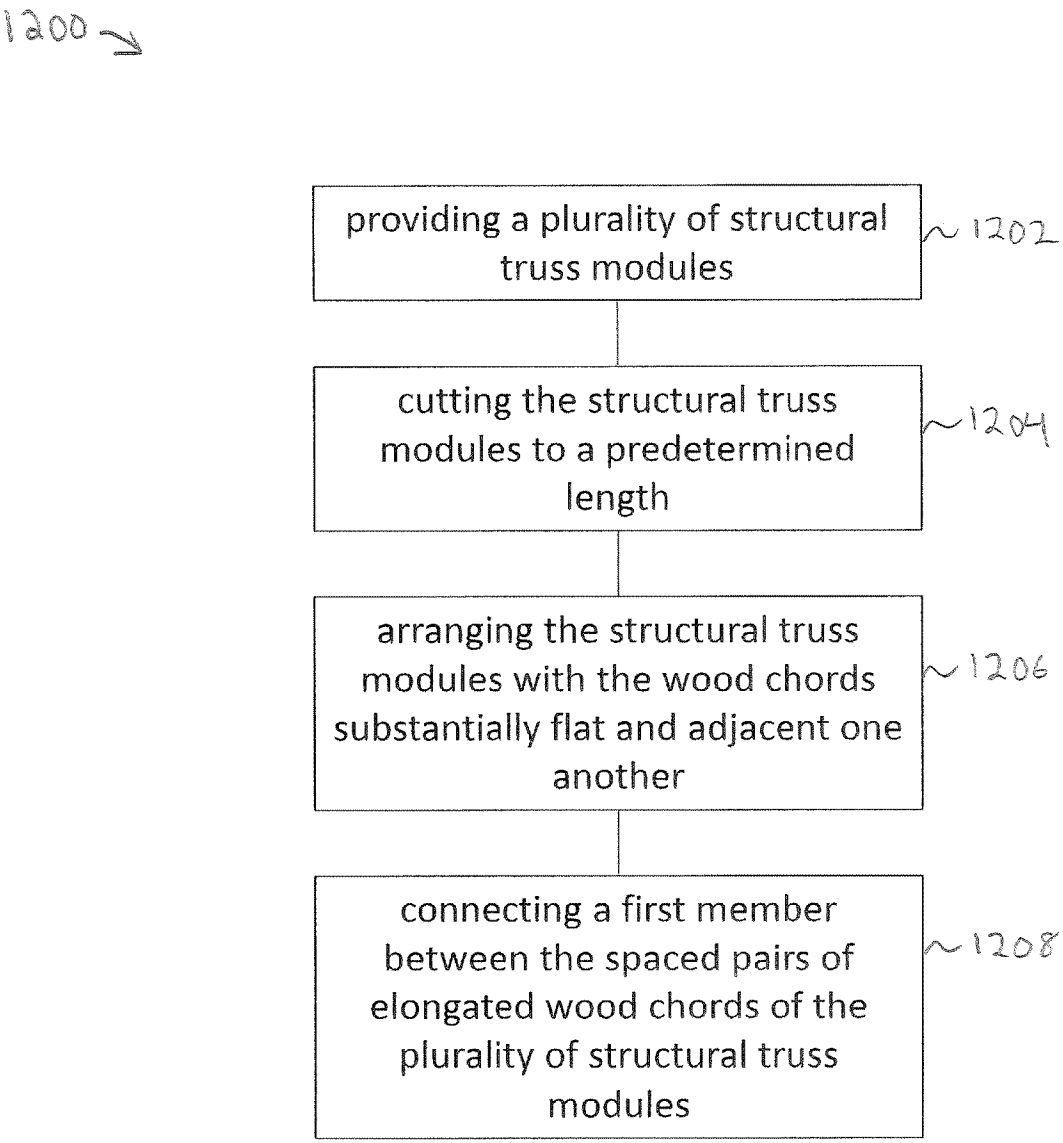
FIG. 36 is a block diagram of another exemplary method of the present disclosure.

FIG. 36 illustrates another exemplary method 1200. The method 1200 includes providing a plurality of structural truss modules (at block 1202). Each one of the structural truss modules comprises a spaced pair of generally parallel elongated wood chords and a web connecting said elongated wood chords, said web comprising a plurality of metal support rods each having a pair of opposed threaded sections, the first of the pair of opposed threaded sections engaged to a first one of the elongated wood chords at an angle thereto, and the second of the pair of opposed threaded sections engaged to the other one of the elongated wood chords at an angle thereto. Cutting the structural truss modules to a predetermined length (at block 1204). Arranging the structural truss modules with the wood chords substantially flat and adjacent one another (at block 1206). The structural truss modules are substantially evenly spaced in a generally parallel orientation. Connecting a first member between the spaced pairs of elongated wood chords of the plurality of structural truss modules (at block 1208). First ends of the plurality of structural truss modules are configured to connect to a ledger member. It should be noted that the illustration of a particular order of the blocks does not necessarily imply that there is a required or preferred order for the blocks and the order and arrangement of the blocks may be varied. Furthermore it may be possible for some blocks to be omitted. Additionally, various features described below may be included in the method.

The method above wherein the first member comprises a blocking member.

The method above wherein the first member comprises a fascia member.

The method above wherein the first member comprises a carrying beam truss member.

The method above wherein the method further comprises connecting the ledger member between the spaced pairs of elongated wood chords at the first ends of the plurality of structural truss modules.

The method above wherein the first member is substantially perpendicular to the plurality of structural truss modules.

The method above wherein at least one of the plurality of structural truss modules comprises a fascia member between the spaced pair of elongated wood chords, wherein the fascia member is substantially parallel to the spaced pair of elongated wood chords.

The method above further comprising connecting a blocking member to the plurality of structural truss modules by installing the blocking member between the spaced pairs of elongated wood chords of the plurality of structural truss modules.

The method above wherein connecting the blocking member to the plurality of structural truss modules further comprises installing the blocking member between adjacent fasteners of the plurality of fasteners.

The method above wherein connecting the blocking member to the plurality of structural truss modules further comprises installing the blocking member between adjacent angled pilot bores of the elongated wood chords.

The method above further comprising providing a carrying beam truss module; cutting the carrying beam truss module to a predetermined length; and attaching the carrying beam truss module to the plurality of structural truss modules.

The method above wherein the carrying beam truss module comprises a spaced pair of elongated wood chords and a web connecting said elongated wood chords, said web comprising a plurality of metal support rods each having a pair of opposed threaded sections, the first of the pair of opposed threaded sections engaged to a first one of the elongated wood chords at an angle thereto, and the second of the pair of opposed threaded sections engaged to the other one of the elongated wood chords at an angle thereto.

Figure 37:
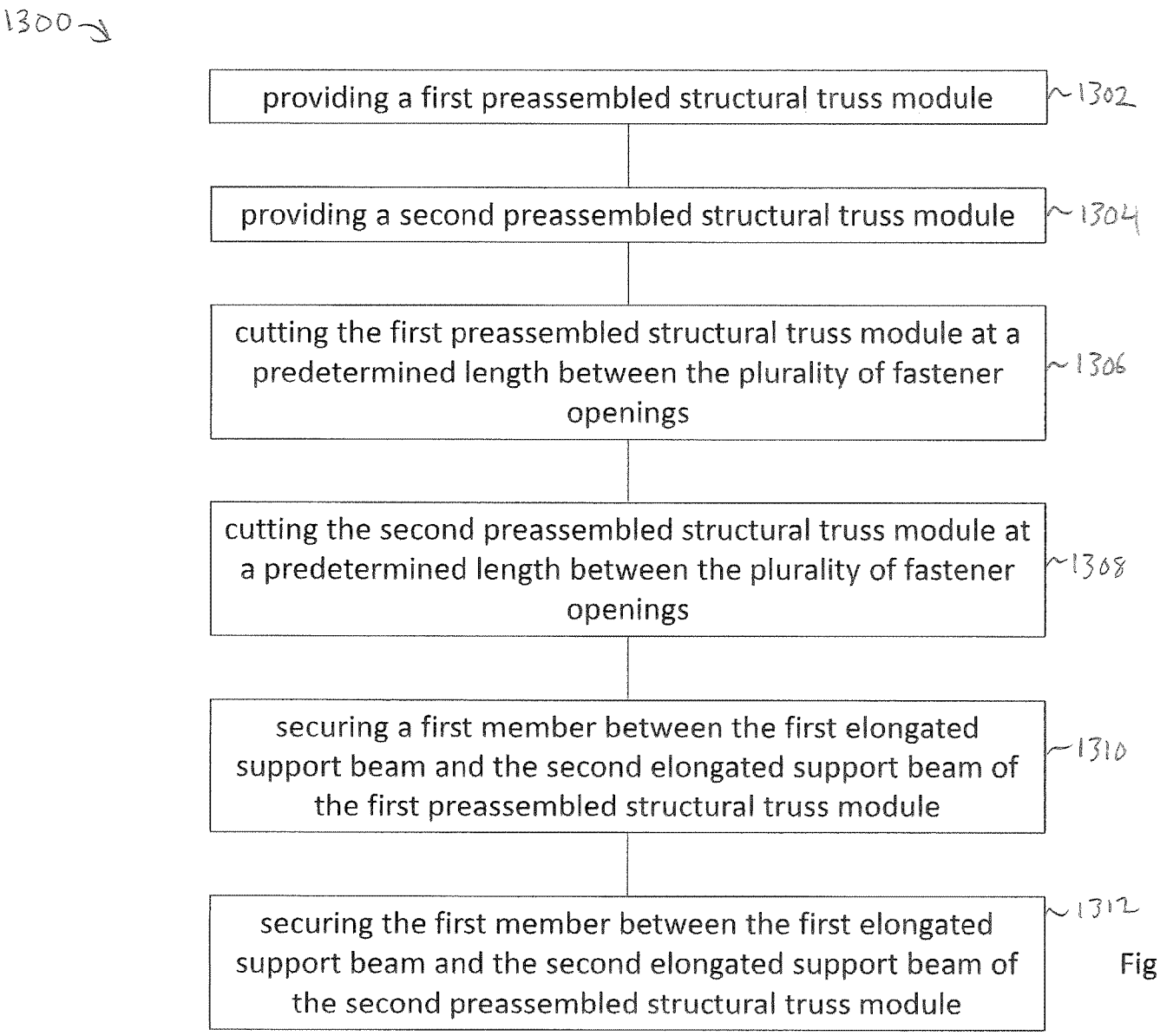
FIG. 37 is a block diagram of another exemplary method of the present disclosure.

FIG. 37 illustrates another exemplary method 1300. The method 1300 includes providing a first preassembled structural truss module (at block 1302). The first preassembled structural truss module comprises a first elongated support beam, a second elongated support beam, and a web connecting said elongated support beams, said web comprising a plurality of rods each having a pair of opposed threaded sections, wherein the first elongated support beam is generally parallel to the second elongated support beam, wherein the first elongated support beam comprises a first surface, a second surface, and a plurality of fastener openings extending between the first surface and the second surface, wherein a first one of the opposed threaded sections is threadably engaged with a portion of one of the plurality of openings of the first elongated support beam, wherein a second one of the opposed threaded sections is threadably engaged with the second elongated support beam. Providing a second preassembled structural truss module (at block 1304). The second preassembled structural truss module comprises a first elongated support beam, a second elongated support beam, and a web connecting said elongated support beams, said web comprising a plurality of rods each having a pair of opposed threaded sections, wherein the first elongated support beam is generally parallel to the second elongated support beam, wherein the first elongated support beam comprises a first surface, a second surface, and a plurality of fastener openings extending between the first surface and the second surface, wherein each rod comprises opposed threaded sections, wherein a first one of the opposed threaded sections is threadably engaged with a portion of one of the plurality of openings of the first elongated support beam, wherein a second one of the opposed threaded sections is threadably engaged with the second elongated support beam. Cutting the first preassembled structural truss module at a predetermined length between the plurality of fastener openings (at block 1306). Cutting the second preassembled structural truss module at a predetermined length between the plurality of fastener openings (at block 1308). Securing a first member between the first elongated support beam and the second elongated support beam of the first preassembled structural truss module (at block 1310). Securing the first member between the first elongated support beam and the second elongated support beam of the second preassembled structural truss module (at block 1312). The first surface of the first elongated support beam of the first preassembled structural truss module is substantially coplanar with the first surface of the first elongated support beam of the second preassembled structural truss module. It should be noted that the illustration of a particular order of the blocks does not necessarily imply that there is a required or preferred order for the blocks and the order and arrangement of the blocks may be varied. Furthermore it may be possible for some blocks to be omitted. Additionally, various features described below may be included in the method.

The method above further comprising: securing a second member between the first elongated support beam and the second elongated support beam of the first preassembled structural truss module; and securing the second member between the first elongated support beam and the second elongated support beam of the second preassembled structural truss module.

The method above wherein the first elongated support beams and the second elongated support beams comprise 2×3 wood chords, 2×4 wood chords, or engineered wood components.

The method above wherein at least one of the rods is oriented at an angle of about 45° to at least one of the first elongated support beam or the second elongated support beam.

Below are provided further descriptions of various non-limiting, exemplary embodiments. The below-described exemplary embodiments may be practiced in conjunction with one or more other aspects or exemplary embodiments. That is, the exemplary embodiments of the invention, such as those described immediately below, may be implemented, practiced or utilized in any combination (e.g., any combination that is suitable, practicable and/or feasible) and are not limited only to those combinations described herein and/or included in the appended claims.

In one exemplary embodiment, a modular building structure comprising: a plurality of structural truss modules, wherein each one of the structural truss modules comprises a spaced pair of elongated wood chords and a web connecting said elongated wood chords, said web comprising a plurality of metal support rods each having a pair of opposed threaded sections, the first of the pair of opposed threaded sections engaged to a first one of the elongated wood chords at an angle thereto, and the second of the pair of opposed threaded sections engaged to the other one of the elongated wood chords at an angle thereto, wherein the spaced pair of elongated wood chords are generally parallel to each other, and wherein each one of the plurality of structural truss modules is substantially evenly spaced from each other and arranged in a generally parallel orientation; a first member extending between the spaced pair of elongated wood chords of the plurality of structural truss modules; and a second member extending between the spaced pair of elongated wood chords of the plurality of structural truss modules.

A modular building structure as above, further comprising a carrying beam truss module connected to the plurality of structural truss modules, wherein the carrying beam truss module comprises a spaced pair of elongated wood chords and a web connecting said elongated wood chords, said web comprising a plurality of metal support rods each having a pair of opposed threaded sections, the first of the pair of opposed threaded sections engaged to a first one of the elongated wood chords at an angle thereto, and the second of the pair of opposed threaded sections engaged to the other one of the elongated wood chords at an angle thereto.

A modular building structure as above, wherein the modular building structure is a modular deck.

Figure 38:
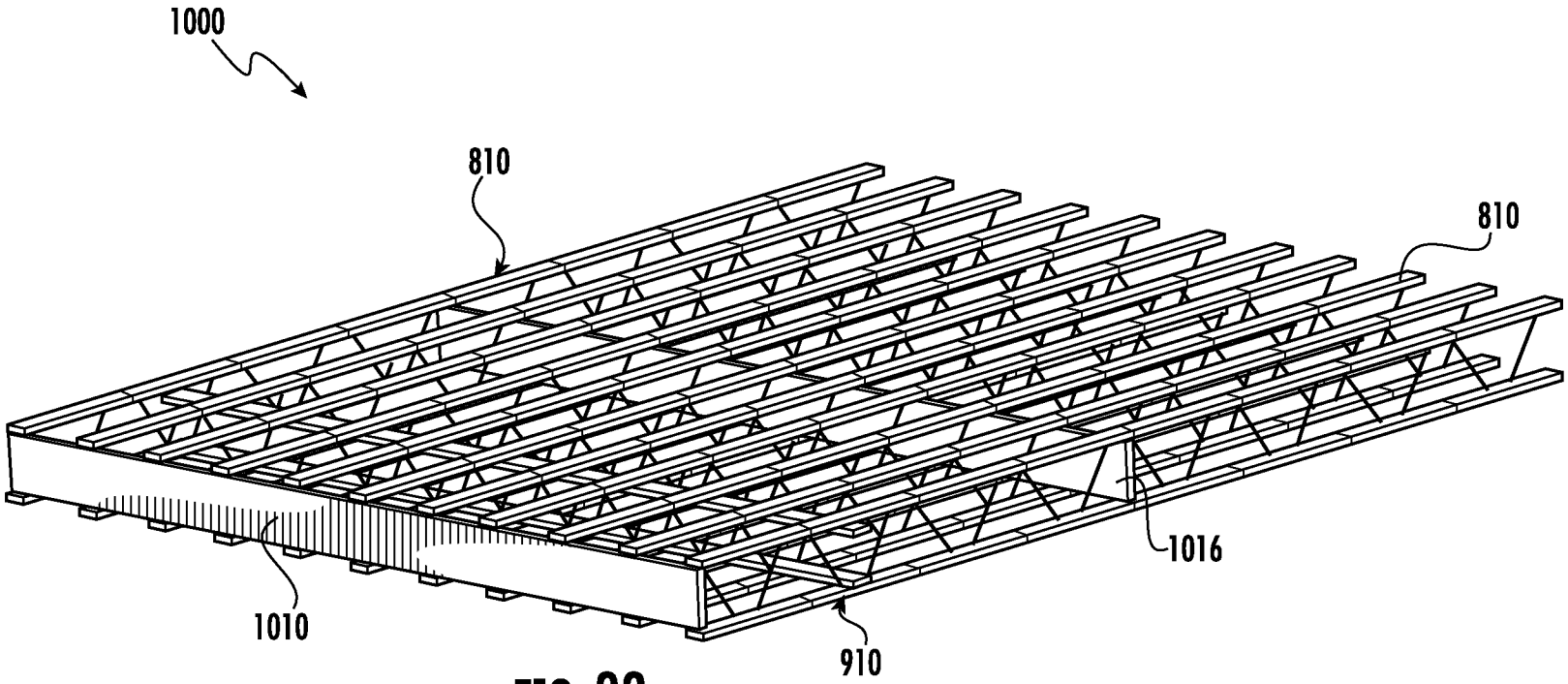
FIG. 38 is a perspective view of a preassembled modular deck incorporating features of the present disclosure.

While the various exemplary embodiments above have been explained with reference to assembling the modular deck at the job site, alternate embodiments may provide for the modular deck to be preassembled at the manufacturing facility and then shipped to the job site (for example, see FIG. 38). For example, the modular deck 1000 can be "pre-assembled" (such that the structural truss modules 810, one or more blocking members 1016, rim fascia 1010, and/or one or more carrying beam truss modules 910 are assembled together as described above) at the manufacturing facility and then attached to the ledger and support posts/footings at the job site.

Figure 39:
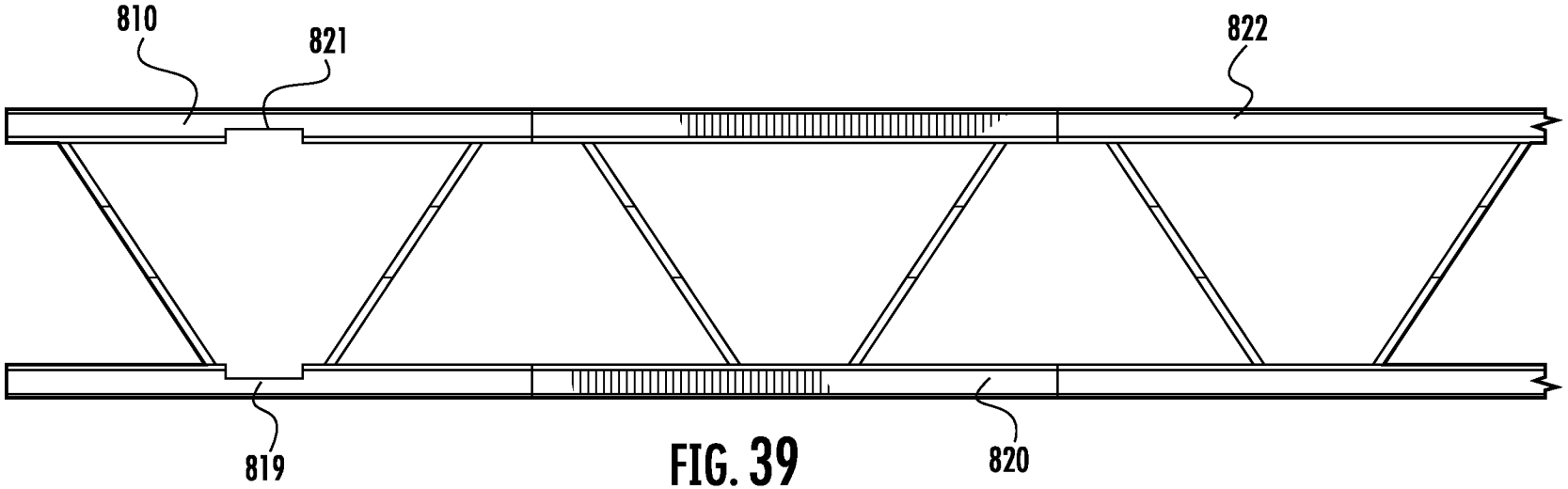
FIG. 39 is a side view of an alternate embodiment of the modular building structure shown in FIG. 21 illustrating portions of the structural truss module.
Figure 40:
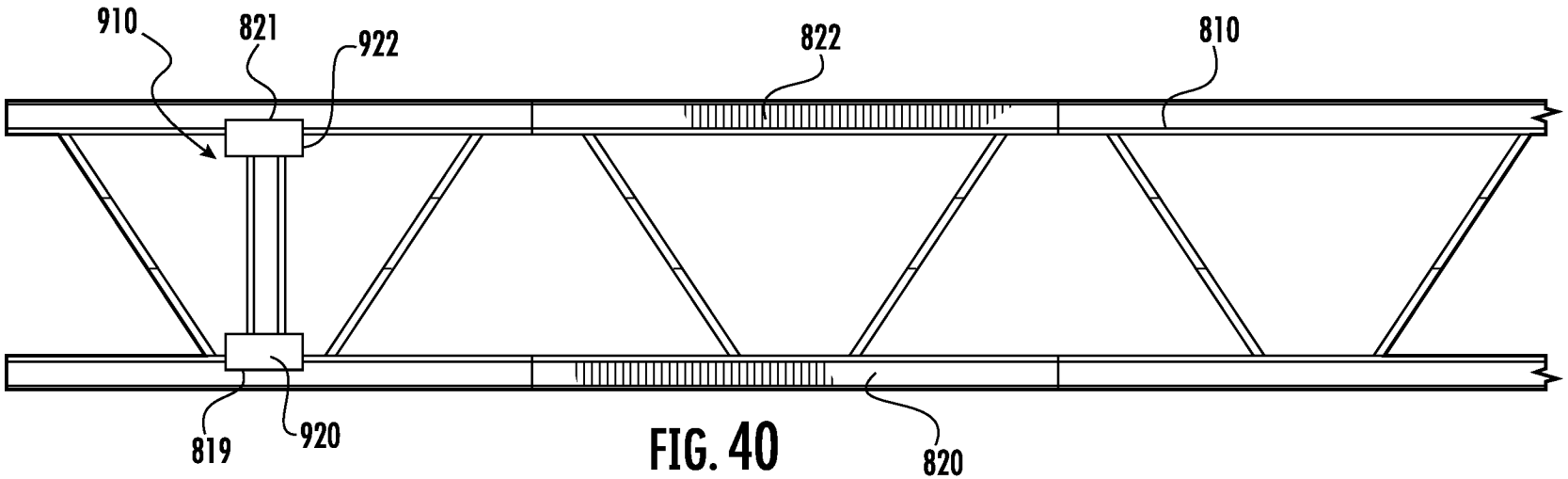
FIG. 40 is a side view of an alternate embodiment of the modular building structure shown in FIG. 21 illustrating the carrying beam truss module between chords of the structural truss module.

Referring now also to FIGS. 39 and 40 there is shown an embodiment having an alternate interface between the carrying beam truss module 910 and the structural truss modules 810. The structural truss modules 810 are still arranged such that lower chords 920 and upper chords 922 of the carrying beam truss modules 910 extend between the lower chords 820 and the upper chords 822 of the structural truss modules 810, however in this embodiment the structural truss modules 810 each comprise recessed surfaces 819, 821 which are sized and shaped to receive the carrying beam truss module.

Each recessed surface 819, 821 extends in a direction perpendicular to the structural truss module and is sized and shaped to receive the lower and upper chords 920, 922 of the carrying beam truss module 910. It should be noted that although FIGS. 39 and 40 illustrate an embodiment where the structural truss module has recessed surfaces configured to receive one carrying beam truss module, alternate embodiments may comprise additional recessed surfaces for any suitable number of carrying beam truss modules.

It should be noted that the structural truss modules, the carrying beam truss modules, rim fascia members, decking members, outer fascia members, and blocking members may comprise any suitable material. For example, these may all be wood, composite, engineered wood components, etc., or any combination thereof.

According to various exemplary embodiments, the modular deck provides various advantages such as added ease and less labor intensive deck construction and faster assembly times.

While preferred embodiments of the foregoing modules and integrated structures have been set for purposes of illustrating preferred embodiments, the foregoing description should not be deemed a limitation of the invention herein. Accordingly, various modifications, adaptations and alternatives may occur to one skilled in the art without departing from the spirit and the scope of the present invention.

The invention claimed is:

1. A method of manufacturing a modular building structure comprising:

providing two structural truss modules, each of the plurality of structural truss modules comprising a spaced pair of elongated wood chords, each of the spaced pair of wood chords extending from a first end to a second end and a web connecting said elongated wood chords to one another and extending through the spacing defined between the spaced pair of wood chords, said web comprising a plurality of substantially linear threaded metal support rods directly threadedly engaged to a first of the spaced pair of elongated wood chords and directly threadedly engaged to a second of the spaced pair of elongated wood chords;

sizing the structural truss modules to a predetermined length by cutting each chord of the respective spaced pair at an intermediate position between the first end and the second end;

arranging the structural truss modules with the first of the wood chords of one module generally coplanar to the first of the wood chords in the other module to define an installation position; and fixing the structural truss modules in the installation position to define a support structure; and attaching one or more additional building members to the support structure laying on the coplanar first of the wood chords of the truss modules obliquely or perpendicular thereto, wherein the additional building members are decking planks.

2. The method of claim 1 wherein step of fixing comprises fixing the first ends of the two structural truss modules relative to a ledger member.

3. The method of claim 2, wherein the two structural truss modules are fixed with the ledger between the spaced pairs of elongated wood chords at the first ends.

4. The method of claim 1 wherein one or more of the one or more additional building members is attached substantially perpendicular to the first and second structural truss modules.

5. The method of claim 1 comprising a step of attaching a fascia member between the spaced pair of elongated wood chords of at least one of the two structural truss modules.

6. The method of claim 1 further comprising connecting a blocking member to the two structural truss modules by installing the blocking member between the spaced pairs of elongated wood chords of each of the structural truss modules.

7. The method of claim 6 wherein connecting the blocking member to the two structural truss modules further comprises installing the blocking member between adjacent metal support rods of the plurality of metal support rods in each of the two structural truss modules.

8. The method of claim 6 wherein connecting the blocking member to the two structural truss modules further comprises installing the blocking member between adjacent angled pilot bores of the elongated wood chords.

9. The method of claim 1, wherein one or both of the spaced pair of elongate wooden chords in one or both of the structural truss modules includes a side groove for optional receipt of hardware.

10. A method of manufacturing a modular building structure comprising:

providing a first preassembled structural truss module, the first preassembled structural truss module comprising a first elongated support beam with a first surface and a second surface, a second elongated support beam spaced from the first elongated support beam with a spacing defined therebetween, and a web connecting said elongated support beams, said web comprising a plurality of linear threaded fasteners, each fastener embedded directly into each of the elongated support beams at a non-perpendicular angle relative to the support beams and non-parallel angle relative to adjacent fasteners to rigidly connect the respective support beams to one another and extending through the spacing;

providing a second preassembled structural truss module, wherein the second preassem bled structural truss module comprising a first elongated support beam with a first surface and a second surface, a second elongated support beam spaced from the first elongated support beam with a spacing defined therebetween, and a web connecting said elongated support beams, said web comprising a plurality of linear threaded fasteners, each fastener embedded directly into each of the elongated support beams at a non-perpendicular angle relative to the support beams and non-parallel angle relative to adjacent fasteners to rigidly connect the respective support beams to one another and extending through the spacing;

cutting the first preassembled structural truss module at a predetermined length between an adjacent pair of the plurality of fasteners;

cutting the second preassembled structural truss module at a predetermined length between an adjacent pair of the plurality of fasteners;

securing a first elongate building member between the first elongated support beam and the second elongated support beam of the first preassembled structural truss module and between adjacent linear threaded fasteners of the plurality of fasteners, the elongate building member extending at a non-parallel angle relative to the first and second elongated support beams of the first truss module; and securing the first elongate building member between the first elongated support beam and the second elongated support beam of the second preassembled structural truss module; wherein the first surface of the first elongated support beam of the first preassembled structural truss module is substantially coplanar with the first surface of the first elongated support beam of the second preassem bled structural truss module.

11. The method of claim 10 further comprising:

securing a second elongate building member between the first elongated support beam and the second elongated support beam of the first preassembled structural truss module; and securing the second elongate building member between the first elongated support beam and the second elongated support beam of the second preassembled structural truss module.

12. The method of claim 10 wherein the first elongated support beams and the second elongated support beams comprise 2×3 wood chords, 2×4 wood chords, or engineered wood components.

13. The method of claim 10 wherein at least one of the rods is oriented at an angle of about 45° to the first elongated support beam and the second elongated support beam.

14. The method of claim 10, comprising a first recess in an inner surface of the first elongated support beam of the first preassembled structural truss module and a second recess in an inner surface of the second elongated support beam of the first preassembled structural truss module, wherein the first recess and second recess are longitudinally aligned with one another, and the first building member is received within the first recess and second recess.

15. The method of claim 10, wherein the elongate building member extends obliquely relative to the first elongated support beam and second elongated support beam of the first preassem bled structural truss module.

16. A method of manufacturing a modular building structure comprising:

providing two structural truss modules, each of the plurality of structural truss modules comprising a spaced pair of elongated wood chords, each of the spaced pair of wood chords extending from a first end to a second end and a web connecting said elongated wood chords to one another and extending through the spacing defined between the spaced pair of wood chords, said web comprising a plurality of substantially linear threaded metal support rods directly threadedly engaged to a first of the spaced pair of elongated wood chords and directly threadedly engaged to a second of the spaced pair of elongated wood chords;

sizing the structural truss modules to a predetermined length by cutting each chord of the respective spaced pair at an intermediate position between the first end and the second end;

arranging the structural truss modules with the first of the wood chords of one module generally coplanar to the first of the wood chords in the other module to define an installation position; and fixing the structural truss modules in the installation position to define a support structure; and attaching one or more additional building members to the support structure laying on the coplanar first of the wood chords of the truss modules obliquely or perpendicular thereto, wherein the structural truss modules are integrated into a decking structure with the coplanar first of the wood chords of the truss modules forming decking joists on which decking planks are supported and secured.

17. A method of manufacturing a modular building structure comprising:

providing a pair of first structural truss modules, each of the pair of first structural truss modules including a pair of elongate wooden chords extending longitudinally from a first end to a second end with a web connecting them with spacing therebetween, the web comprising a first linear fastener embedded directly into the wooden material of each of the pair of elongate wooden chords and an adjacent second linear fastener embedded directly into the wooden material of each of the pair of elongate wooden chords with longitudinal spacing between the first linear fastener and second linear fastener;

fixing the pair of first structural truss modules relative to an underlying support member with a first wooden chord of a first of the pair of first structural truss modules substantially coplanar to a first wooden chord of the second of the pair of first structural truss modules to form a receiving level; and attaching a plurality of decking planks to the pair of first structural truss modules laying on the receiving level obliquely or perpendicularly to the first wooden chord of the pair of first structural truss modules to form a decking structure.

* * * * *